US010648217B2

(12) United States Patent
Bis et al.

(10) Patent No.: US 10,648,217 B2
(45) Date of Patent: May 12, 2020

(54) RAILROAD HOPPER CAR BODY FITTINGS

(71) Applicant: NATIONAL STEEL CAR LIMITED, Hamilton (CA)

(72) Inventors: Tomasz Bis, Ancaster (CA); Oliver M. Veit, Hamilton (CA)

(73) Assignee: National Steel Car Limited, Ontario (CA)

( * ) Notice: Subject to any disclaimer, the term of this patent is extended or adjusted under 35 U.S.C. 154(b) by 331 days.

(21) Appl. No.: 15/491,390

(22) Filed: Apr. 19, 2017

(65) Prior Publication Data

US 2018/0305967 A1 Oct. 25, 2018

(51) Int. Cl.

| | |
|---|---|
| ***B61D 7/02*** | (2006.01) |
| ***E05F 15/53*** | (2015.01) |
| ***B61D 7/28*** | (2006.01) |
| ***B61D 7/18*** | (2006.01) |

(52) U.S. Cl.

CPC ..... *E05F 15/53* (2015.01); *B61D 7/18* (2013.01); *B61D 7/28* (2013.01); *E05Y 2201/422* (2013.01); *E05Y 2201/448* (2013.01); *E05Y 2201/626* (2013.01); *E05Y 2201/686* (2013.01); *E05Y 2900/51* (2013.01); *E05Y 2900/60* (2013.01)

(58) Field of Classification Search

CPC ... B61D 7/18; B61D 7/28; B61D 7/26; B61D 7/02; B61D 7/24; B61D 7/08; E05F 15/53; E05Y 2201/422; E05Y 2201/448; E05Y 2201/626; E05Y 2201/686; E05Y 2900/51; E05Y 2900/60; B60P 1/56

See application file for complete search history.

(56) References Cited

U.S. PATENT DOCUMENTS

| | | | |
|---|---|---|---|
| 673,103 | A | 4/1901 | Williamson et al. |
| 686,902 | A | 9/1901 | Muller et al. |
| 688,809 | A | 12/1901 | Hansen |
| 693,132 | A | 2/1902 | Heiden |
| 3,315,616 | A | 4/1967 | Beaver et al. |
| 3,316,857 | A | 5/1967 | Floehr |
| 3,596,608 | A | 8/1971 | Aquino et al. |
| 3,633,515 | A | 1/1972 | Shaver et al. |
| 3,717,110 | A | 2/1973 | Miller |
| 3,772,996 | A | 11/1973 | Schuller |
| 3,786,764 | A | 1/1974 | Beers, Jr. et al. |
| 3,800,711 | A | 4/1974 | Tutlle |
| 3,805,708 | A | 4/1974 | Schuller et al. |
| 3,815,514 | A | 6/1974 | Heap |
| 3,902,434 | A | 9/1975 | Barnard et al. |

(Continued)

*Primary Examiner* — Mark T Le

(74) *Attorney, Agent, or Firm* — Hahn Loeser & Parks LLP

(57) ABSTRACT

A railroad hopper car body includes a set of hopper and hopper discharges. Egress of lading from the discharges is governed by movable doors that swing between a closed position and an open position. The motion is driven by a mechanical transmission that is itself driven by an actuator. Each pair of doors is driven by a single actuator. The actuator is mounted to act through the center sill. A portion, or substantially all, of the actuator may be mounted in a predominantly squat, vertical orientation within the center sill. In alternate embodiments, the transmission output may be bifurcated. The center sill bottom flange may be narrower adjacent to the doors. The mechanism may have a secondary lock. The mechanism may have an auxiliary manual release.

19 Claims, 17 Drawing Sheets

(56) References Cited

U.S. PATENT DOCUMENTS

| | | | | |
|---|---|---|---|---|
| 3,931,768 | A | 1/1976 | Price et al. | |
| 4,194,450 | A * | 3/1980 | Miller | B61D 7/24 105/253 |
| 4,224,877 | A | 9/1980 | Stark et al. | |
| 4,250,814 | A | 2/1981 | Stark et al. | |
| 4,601,244 | A | 7/1986 | Fischer | |
| 4,688,488 | A | 8/1987 | Adams et al. | |
| 4,741,274 | A * | 5/1988 | Ferris | B61D 7/18 105/240 |
| 4,766,820 | A | 8/1988 | Ritter et al. | |
| 4,843,974 | A | 7/1989 | Ritter et al. | |
| 6,019,049 | A | 2/2000 | Gaydos et al. | |
| 7,681,507 | B2 | 3/2010 | Herzog et al. | |
| 7,832,340 | B2 | 11/2010 | Dorian | |
| 7,891,304 | B2 | 2/2011 | Herzog et al. | |
| 9,120,491 | B2 | 9/2015 | Creighton | |

* cited by examiner

RAILROAD HOPPER CAR BODY FITTINGS

FIELD OF THE INVENTION

This invention relates to the field of railroad freight cars, and, in particular to railroad freight cars such as may employ bottom unloading doors.

BACKGROUND

There are many kinds of railroad cars for carrying particulate material, be it sand or gravel aggregate, plastic pellets, grains, ores, potash, coal or other granular materials. These materials are not liquid, yet may in some ways tend to flow in a somewhat liquid-like manner. Many of those cars have an upper opening, or accessway of some kind, by which the particulate is loaded, and a lower opening, accessway, or door, by which the particulate material exits the car under the influence of gravity. Clearly, while the inlet opening need not necessarily have a movable door (but may include a cover to discourage contamination of the lading or exposure of the lading to the wind, rain or snow), the outlet opening requires a governor of some kind that is movable between a closed position for retaining the lading while the lading is being transported, and an open position for releasing the lading at the destination. The terminology "flow through" or "flow through railroad car" or "center flow" car, or the like, may sometimes be used for cars of this nature where lading is introduced at the top, and flows out at the bottom.

Consider, for example, a hopper car for transporting sand or gravel aggregate. It may have a converging hopper discharge section that has the shape, generally speaking, of an inverted four sided, truncated pyramid. At the truncated bottom end, there may be a stationary plate and a moving plate, or door. When the moving plate and the stationary plate are brought together, the door is closed. The car is filled with lading, and is hauled to its destination. At the destination, the door or gate is opened, and the lading is allowed to escape from the hopper. The doors are driven by actuators connected to the doors by mechanical transmission elements.

SUMMARY OF THE INVENTION

In an aspect of the invention, there is a railroad hopper car having a hopper car body carried on railroad car trucks for rolling motion in a longitudinal direction. The railroad hopper car has a center sill. It also has a first hopper. The first hopper has a bottom discharge. The bottom discharge has a movable door mounted to govern egress of lading from the first hopper. The movable door being driven by a door actuator. The door actuator being located at the center sill. The door actuator is predominantly upstandingly oriented.

In a feature of that aspect of the invention, the door is a transverse door. In another feature, the railroad hopper car has first and second spaced apart side walls extending therealong. The first hopper has a first slope sheet extending obliquely upwardly away from the bottom discharge. The actuator is mounted in the lee of the first slope sheet. In another feature at least a portion of the actuator is mounted within the center sill. In another feature the actuator acts amidst the center sill. In still another feature, the actuator has a line of action that acts through the center sill. In a further feature, the center sill extends through the first hopper. In a still further feature, the door of the first hopper is split into first and second portions lying laterally to either side of the center sill. In another feature, the actuator is connected to the door by a mechanical transmission, and the mechanical transmission is bifurcated to drive the first and second portions. In another feature, the first and second portions are yoked to sweep through a common arc together. In another feature, the actuator is mounted on the car centerline.

In another aspect of the invention there is a railroad hopper car having a hopper car body supported by railroad car trucks for rolling motion in a longitudinal direction. The railroad hopper car has a center sill. It includes a first hopper, the first hopper having a bottom discharge. The bottom discharge has a movable door mounted to govern egress of lading from the first hopper. An actuator is connected to drive the movable door. The door actuator is predominantly upstandingly oriented. At least part of the door actuator being mounted within the center sill.

In a feature of that aspect of the invention, the center sill has a pair of spaced apart webs and a bottom flange. The bottom flange has a first portion having a first width adjacent the door, and a second portion having a second width adjacent the actuator. The first width is narrower than the second width. The door is mounted to swing beside the center sill alongside the first portion. The second portion has an aperture formed therein to permit the actuator to work therethrough. The actuator is connected to the door by a linkage that folds at least partially into the center sill. In another feature the actuator is connected to the door by mechanical linkages, and one of the linkages has a fulcrum mounted under the center sill. In a further feature, the actuator has a reaction mounted on top of the center sill. In another feature, the door is a transverse hopper door having first and second portions to either side of the center sill. In a further feature, the actuator is connected by a bifurcated linkage to drive the first and second portions of the door. In a still further feature, the first and second portions of the door are yoked to sweep together. In another feature, in a closed position of the door, the door has a free edge most distant from the actuator. The free edge has a backing beam extending thereacross. The backing beam yokes the first and second portions of the door together. The actuator is connected to the door by a mechanical transmission that includes a linkage mounted to the backing beam.

In another feature, the door is movable between an open position and a closed position. The actuator is connected to the door by linkages. The linkages are movable to an over-center condition when the door is in the closed position. The linkages have a secondary lock operable to discourage movement out of the over-center condition when the actuator is passive.

In another aspect of the invention there is a secondary lock for a railroad hopper car door transmission, the secondary lock being mounted to body structure of the hopper car.

In a feature of that aspect of the invention, the secondary lock includes a base mounted to the body structure of the hopper car and a movable member that is biased toward engagement with the door transmission. The movable member has a first position in which it intercepts the door transmission, and a second position in which it is disengaged from the door transmission. In another feature, the movable member has a pawl operable to interact with a catch of the door transmission. In a further feature, the secondary lock includes a follower engagable with the door transmission, the follower being operable to release the secondary lock from the door transmission.

In still another feature there is a combination of the secondary lock and the door transmission more generally.

The door transmission includes a catch, and the secondary lock includes a pawl. The pawl and the catch are mutually engaged when the door transmission is in a primary lock configuration. In another feature the secondary lock includes a follower and the door transmission includes a moving member. The moving member is operable in motion to engage the follower and thereby to release the secondary lock. In yet another feature the door transmission includes a sequencing member, and, when the sequencing member is moved, the secondary lock is released during a first portion of motion of the sequencing member. The transmission is released from a primary lock configuration during a second portion of motion of the sequencing member.

In another feature there is a linkage mounted to drive a door of a hopper, and an actuator mounted to drive the linkage. The linkage is drivable by the actuator to a primary lock configuration in which the linkage is in an over-center condition. There is a sequencing member, a catch, and a release member. The secondary lock is biased to engage the linkage. The secondary lock includes a pawl. The pawl is biased to engage the catch when the linkage is driven to the over-center condition. When so engaged, engagement of the pawl with the catch prevents the linkage from moving out of the over-center condition. The secondary lock includes a follower for engagement with the release member. The sequencing member is a lost motion fitting driven by the actuator. The actuator is operable to drive the lost motion fitting through a first portion of motion. During the first portion of motion the actuator also drives the release member in engagement with the follower to release the secondary lock. The actuator is operable to drive the lost motion fitting through a second portion of motion after the first portion of motion; and, during the second portion of motion the actuator also drives the linkage out of the over-center condition. In another feature, the sequencing member is mounted between the actuator and the linkages, whereby the actuator is operable to drive the linkage through the sequencing member. In still another feature, the lost motion fitting is an elongate slot in the sequencing member, and the release member is a cam that co-operates with the follower.

In another aspect of the invention there is a railroad hopper car door operating mechanism. It has an actuator, a primary lock, a secondary lock, a sequencing member, and a manual release operable when the actuator is inactive to release the secondary lock and the primary lock.

In a feature of that aspect, the manual release is operable to disengage the secondary lock prior to disengagement of the primary lock. In another feature, the manual release is mounted to the sequencing member. In another feature, the manual release member is movable. A first stationary member is mounted to the hopper car. The first stationary member functions as a fulcrum to permit a person standing at trackside to engage the release member with a lever, using the first stationary member as a fulcrum. In another feature, a second stationary member is mounted to the railcar. The second stationary member defines a lever guide by which a person standing at trackside may feed a first end of a lever to engage the manual release. In another feature the door operating mechanism includes a linkage mounted to drive a hopper door. The linkage is drivable to an over-center condition when the door is closed. The over-center condition defines the primary lock. The sequencing member is a lost motion member mounted between the actuator and the linkage. The linkage has a catch that is engaged by a pawl when the linkage is in the over-center condition, thereby preventing the linkage from moving out of the over-center condition, the catch and pawl defining the secondary lock. The lost motion member is movable when the manual release is driven first to release the secondary lock while taking up lost motion therein, and then to release the primary lock after lost motion therein is exhausted.

These and other aspects and features of the invention may be understood with reference to the description which follows, and with the aid of the illustrations of a number of examples.

BRIEF DESCRIPTION OF THE FIGURES

The description is accompanied by a set of illustrative Figures in which.

DETAILED DESCRIPTION

Figure 1A:
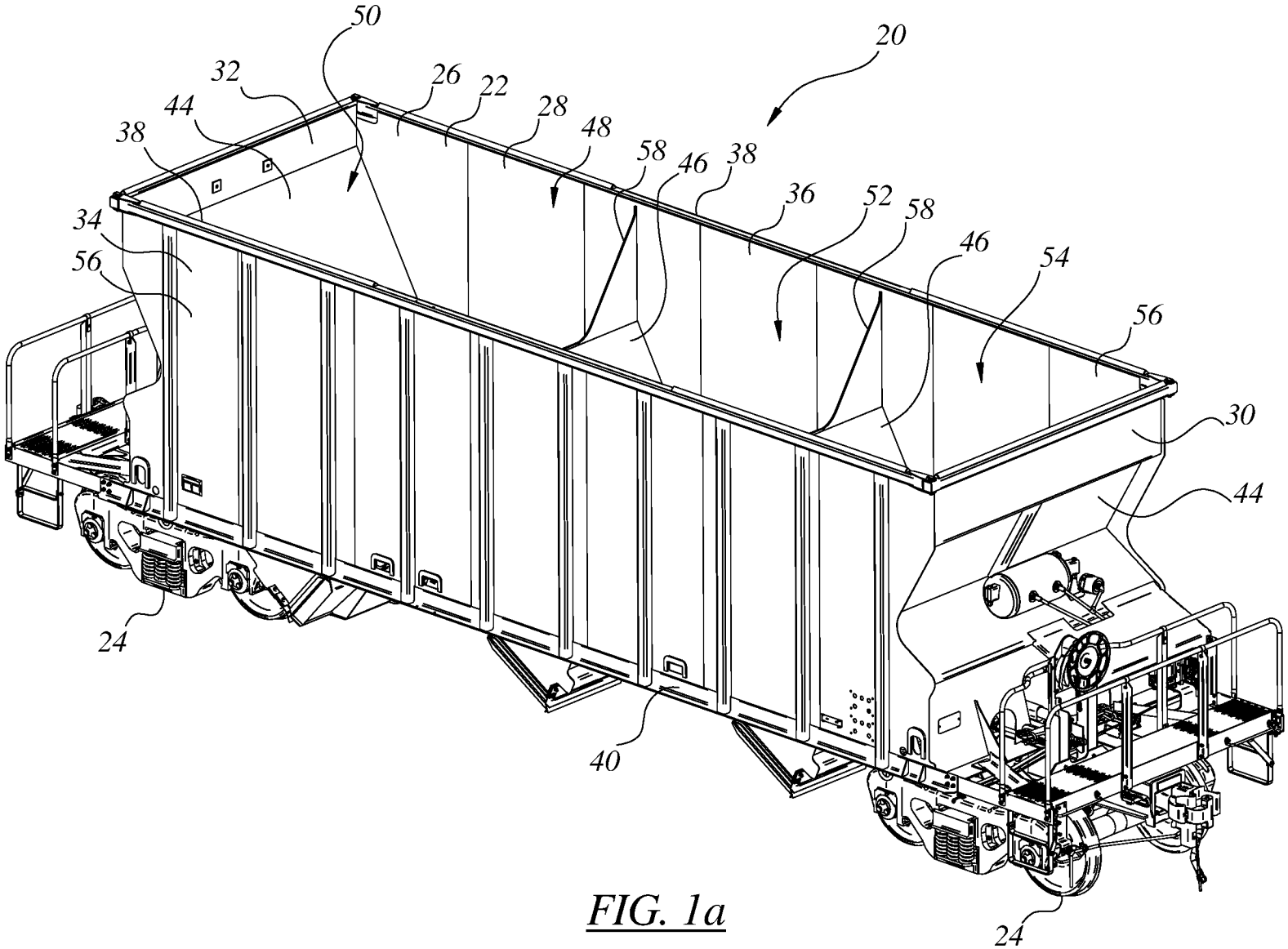
FIG. 1*a* is a general arrangement, isometric view of a railroad freight car.
Figure 1B:
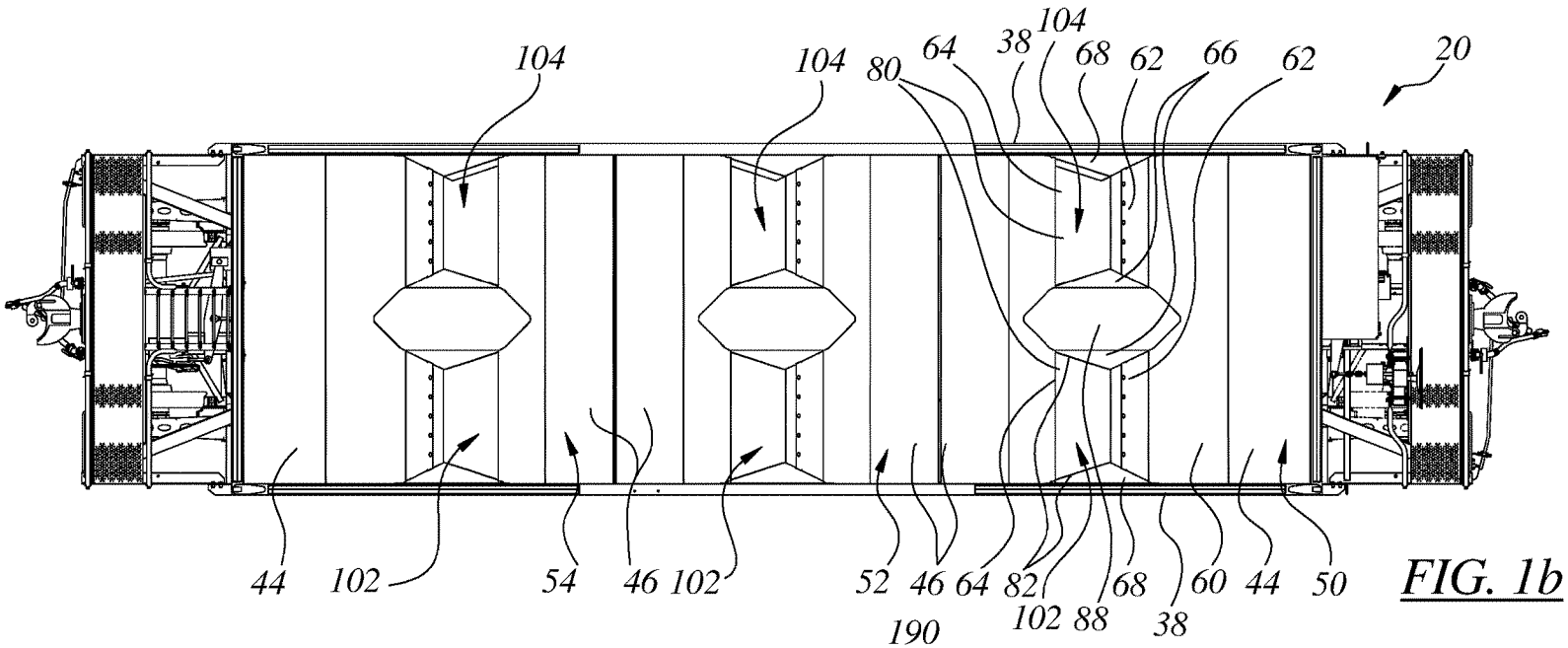
FIG. 1*b* is a top view of the railroad freight car of FIG. 1*a;*
Figure 1C:
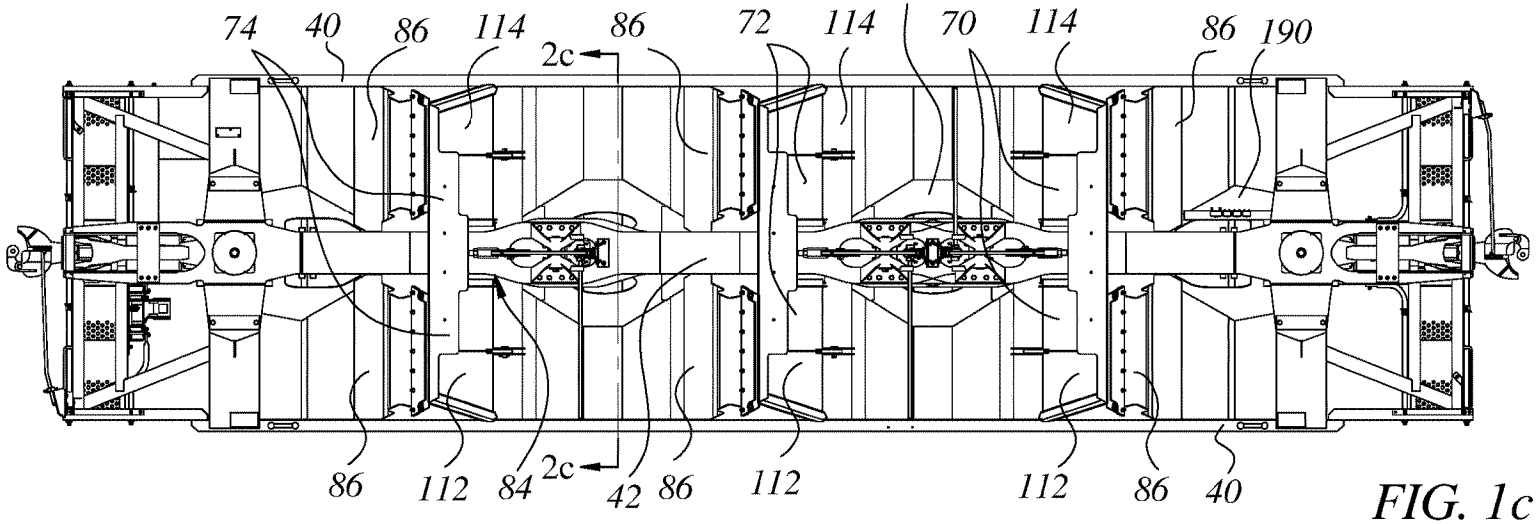
FIG. 1*c* is a bottom view of the railroad freight car of FIG. 1*a;*
Figure 1D:
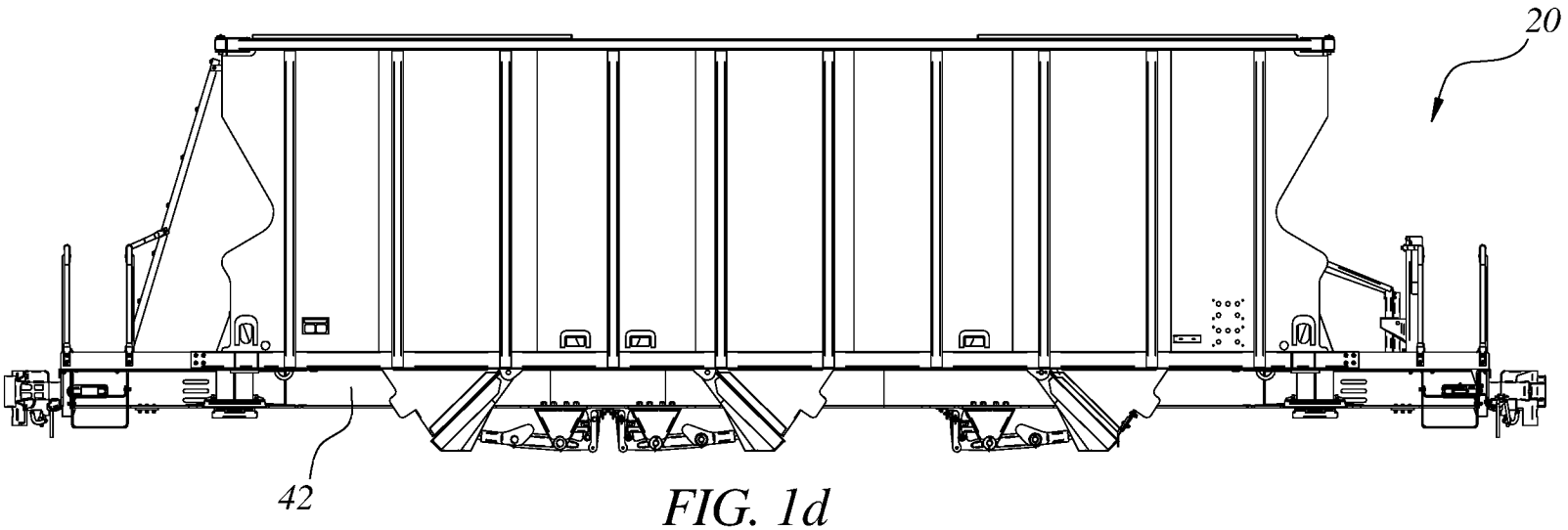
FIG. 1*d* is side view of the railroad freight car of FIG. 1*a;*

The description that follows, and the embodiments described therein, are provided by way of illustration of an example, or examples, of particular embodiments of the principles, aspects or features of the present invention. These examples are provided for the purposes of explanation, and not of limitation, of those principles and of the invention. In the description, like parts are marked throughout the specification and the drawings with the same respective reference numerals. The drawings are not necessarily to scale and in some instances proportions may have been exaggerated in order more clearly to depict certain features of the invention.

The terminology used herein is thought to be consistent with the customary and ordinary meanings of those terms as they would be understood by a person of ordinary skill in the railroad industry in North America. Following from *Phillips v. AWH Corp.*, the Applicant expressly excludes all interpretations that are inconsistent with this specification, and, in particular, expressly excludes any interpretation of the claims or the language used in this specification such as may be made in the USPTO, or in any other Patent Office, other than those interpretations for which express support can be demonstrated in this specification or in objective evidence of record in accordance with *In re Lee*, (for example, earlier publications by persons not employed by the USPTO or any other Patent Office), demonstrating how the terms are used and understood by persons of ordinary skill in the art, or by way of expert evidence of a person or persons of at least 10 years experience in the railroad industry in North America or in other former territories of the British Empire and Commonwealth.

In terms of general orientation and directional nomenclature, for railroad cars described herein the longitudinal direction is defined as being coincident with the rolling direction of the railroad car, or railroad car unit, when located on tangent (that is, straight) track. In the case of a railroad car having a center sill, the longitudinal direction is parallel to the center sill, and parallel to the top chords. Unless otherwise noted, vertical, or upward and downward, are terms that use top of rail, TOR, as a datum. In the context of the car as a whole, the term lateral, or laterally outboard, or transverse, or transversely outboard refer to a distance or orientation relative to the longitudinal centerline of the railroad car, or car unit, or of the centerline of a centerplate at a truck center. The term "longitudinally inboard", or "longitudinally outboard" is a distance taken relative to a mid-span lateral section of the car, or car unit. Pitching motion is angular motion of a railcar unit about a horizontal axis perpendicular to the longitudinal direction. Yawing is angular motion about a vertical axis. Roll is angular motion about the longitudinal axis. Given that the railroad car described herein may tend to have both longitudinal and transverse axes of symmetry, a description of one half of the car may generally also be intended to describe the other half as well, allowing for differences between right hand and left hand parts. To the extent that this specification or the illustrations may refer to standards of the Association of American Railroads (AAR), such as to AAR plate sizes, those references are to be understood as at the earliest priority date to which this application is entitled.

FIG. 1*a* shows an isometric view of an example of a railroad freight car 20 that is intended to be representative of a wide range of railroad cars in which the present invention may be incorporated. While car 20 may be suitable for a variety of general purpose uses, it may be taken as being symbolic of, and in some ways a generic example of, a flow through car, in which lading is introduced by gravity flow from above, and removed by gravity discharge through gated or valved outlets below. Flow through, or center flow cars may include open topped hopper cars, grain cars, plastic pellet cars, potash cars, ore cars, and so on. In one embodiment car 20 may be a hopper car such as may be used for the carriage of bulk commodities in the form of a granular particulate, be it in the nature of relatively coarse gravel or fine aggregate in the nature of fine gravel or sand or various ores or concentrate or coal. Car 20 may be symmetrical about both its longitudinal and transverse, or lateral, centreline axes. Consequently, it will be understood that the car has first and second, left and right hand side beams, bolsters and so on.

By way of a general overview, car 20 may have a car body 22 that is carried on trucks 24 for rolling operation along railroad tracks. Car 20 may be a single unit car, or it may be a multi-unit car having two or more car body units, where the multiple car body units may be connected at an articulated connector, or by draw bars. Car body 22 may have a lading containment vessel or shell 26 such as may include an upstanding wall structure 28 which may have a pair of opposed first and second end walls 30, 32, that extend cross-wise, and a pair of first and second side walls 34, 36 that extend lengthwise. The end walls 30, 32 and side walls 34, 36 co-operate to define a generally rectangular form of peripheral wall structure 28. Wall structure 28 may include top chords 38 running along the top of the walls, and side sills 40 running fore-and-aft along lower portions the side sheets of side walls 34, 36. In some instances car 20 may have stub center sills at either end, in which case side walls 34, 36 may act as deep beams, and may carry vertical loads to main bolsters that extend laterally from the centerplates. Alternatively, or in addition to deep side beams, car 20 may include a center sill 42, which may be a straight-through center sill, running from one end of the car body to the other. In the case of a single, stand alone car unit, draft gear and releaseable couplers may be mounted at either end of the center sill. In a center flow, or flow through car, the upper portion of the car may typically include means by which to admit lading under a gravity drop system. Such an intake, or entryway, may be a large rectangular opening such as bounded by top chords 38, or the car may have one or more hatches, whether covered or uncovered.

The interior of car body 22 may include end slope sheets 44 and lateral partitions such as may be identified as intermediate slope sheets 46 that may extend between the side walls of the car, in a manner such as may tend to divide the internal space 48 of car body 22 into two or more sub-compartments, sub-volumes or subspaces indicated generally as 50, 52 and 54 in this example, and which may be referred to as first, second, and third hoppers. Clearly, in some embodiments there may be one single hopper, in others two hoppers and in others three, four, or more hoppers. The hoppers are bounded on their sides by side sheets 56 of side walls 34 and 36 that run between side sills 40 and top chords 38.

Car 20 may have relatively large slope sheets, be they 44 or 46, that extend cross-wise between side walls 34, 36, and which may tend to extend to a height relatively close to top chords 38. As may be noted, end sheets 44 may be slope sheets, and internal partition sheets 46 may also be slope sheets. Not atypically, each pair of fore- and aft opposed slope sheets, be they end sheets or internal partitions, may be inclined at equal and opposite angles, and the angles of those sheets may be selected to be somewhat steeper than the free slope angle, or natural talus slope angle, or angle of repose, of the lading for which the car is designed, such that, when the gates are opened, the lading may tend to flow out, rather than sit at rest. That is, taking either the coupler centerline height or the center sill cover plate upper surface as a datum, slope sheets 46 may terminate at a height that is at least half way to top chord 38, and which may, in some embodiments, extend more than ⅔, ¾ or ⅘ of that distance, as may be.

Car 20 may include a fitting mounted at the apex where two adjacent slope sheets 46 meet. It be termed a partition, or a divider, or reinforcement, and may be referred to as a ridge plate 58. Ridge plate 58 may include a central portion, and end portions mated to the side walls.

The lower regions of car body 22 may include gate or discharge assemblies 60, for the various hoppers, however many there may be, by which one or more members that are movable between closed and open positions may be used as a flow control to govern the egress of lading from that hopper. Discharge assemblies 60 may include the lower portion of, or a continuation of, one or both of the fore-and-aft slope sheets defining the fore and aft walls of that hopper. For example, hopper 50 (it being chosen arbitrarily, and generically) may include a first fore-and-aft hopper slope sheet extension 62, mounted to one slope sheet, e.g., item 44, and a second fore-and-aft slope sheet extension 64 mounted to an opposed slope sheet, e.g., be it item 46.

Discharge assemblies 60 may also include a pair of opposed inboard and outboard side sheet members, 66, 68. Side sheet members 66, 68 may be steel plates, and may be positioned to co-operate with slope sheet extension 62 to define a converging, or funnel-like passageway, or conduit, leading to a throat, or opening, indicated generally as 80, at which an exit, or port, or gate, however it may be termed, is defined. Each of hoppers 50, 52, 54 has a respective door or door assembly 70, 72, 74, each mounted at a respective pivot or hinge fitting 78. In the embodiment shown, all of these door assemblies are the same. Consequently only one such door will be described. It may also be noted that the presence of center sill 42 divides the opening into two portions, a first, or left-hand portion 102 lying to one side of center sill 42, and a second, or right-hand portion 104 lying to the other side of center sill 42. From one point of view, each corresponding door may therefore be considered as being a pair of two doors 112, 114; from another point of view each door may be considered to be a single door having two portions or halves, i.e., 112, 114. In a stub sill car, the opening could be uninterrupted, and could form a single continuous gate across the width of the car. Given that it is customary to discharge lading on both sides of the center sill at the same time to avoid asymmetric load distribution (as might tend to encourage the car to lean to one side, or tip), the right and left hand door portions are driven together. In the embodiments shown and described herein, the doors are yoked together by physical structure to compel them to sweep through the same arc at the same time. Accordingly, the choice of terminology of items 102, 104, 112 and 114 is somewhat arbitrary.

Looking at a single door portion, the sides of the periphery of any one left-hand or right-hand discharge opening 80 may be defined by the margins 82 of side sheet members 66 and 68 that angle upwardly and away from slope sheet extension 62. The bottom edge, or sill, of the discharge opening may be defined by the lowest margin or extremity of slope sheet extension 62, or such fittings or assemblies as may be mounted thereto. First slope sheet extension 62 may be a panel that is rigidly fixed relative to the first slope sheet, and may be made from a metal, such as a steel, that may serve as a wear plate, and which may be hardened or alloyed for such a purpose. Slope sheet extension 62 may be reinforced along its lower lateral margin by a lip stiffening member 86, which may be a U-pressing, or channel, mounted to the outside face of extension 62 and forming a hollow section therewith, capped by the wings, or tabs 76 of side sheet members 66, 68.

Figure 1E:
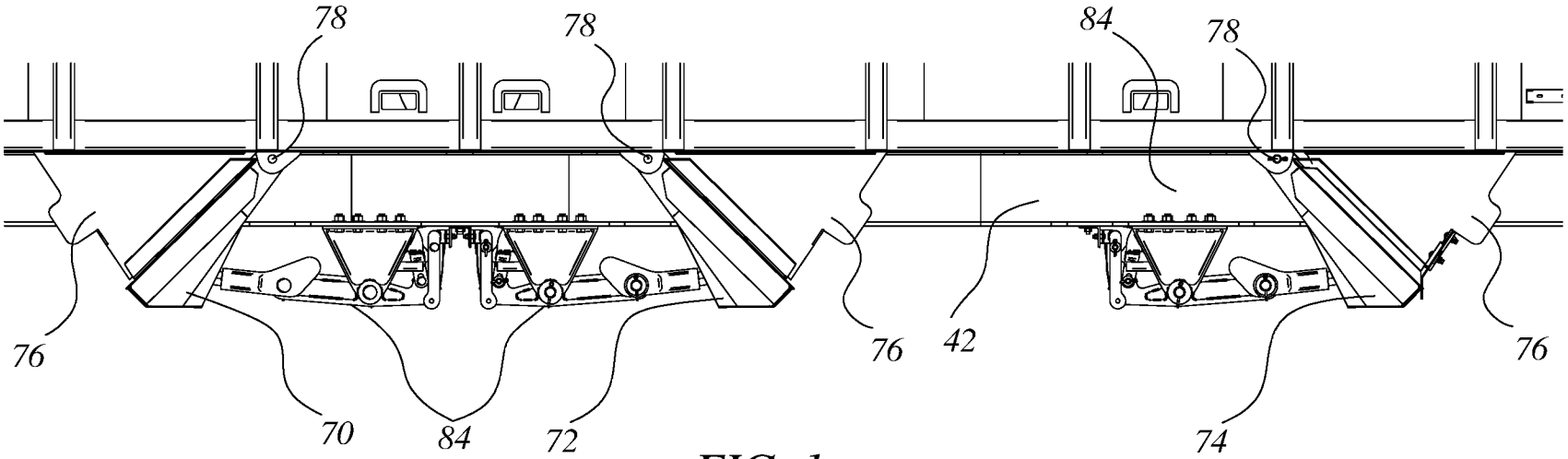
FIG. 1*e* is an enlarged view of a detail of FIG. 1*d*, showing the door and door actuator layout of the freight car of FIG. 1*a;*

Slope sheet extension 64 may be a movable slope sheet extension, and may be, or may be part of, a moveable closure member or closure assembly 84 that is mounted to move between a closed position (FIG. 1*e*) obstructing flow through throat 80, and an open position (FIG. 3*d*) in which flow through throat 80 is less obstructed, such that lading may be discharged. In FIG. 3*d*, the open position corresponds, roughly to a vertical orientation of the lading-facing surface of the door. To that end, slope sheet extension 64 may be connected to the rest of body 22 at a hinged or pivoted member, such as a pivot pin or hinge 78, such as may tend to constrain slope sheet extension 64 to a single degree of motion relative to opening 80, which, in one embodiment, may be angular displacement (i.e., rocking or pivoting motion, about an axis, such as the axis of hinge 78). By virtue of its motion, slope sheet extension 64 may be considered to be, or to be part of, the door or door assembly, or closure, or closure assembly or sub-assembly, such as may be referred to generally as 90.

Where car 20 includes a straight through center sill, such as item 42, rather than having a single full width hopper discharge door assembly 90, such as might tend to be centered on the longitudinal centerline of the car, there may be two such discharge assemblies 90, one mounted to either side of center sill 42, in car 20. In this latter case, the center sill may tend to be protected from abrasion or other damage by one or more shrouds 88. Shroud 88 may, in cross-section, have the form of an inverted V, whose arms may extend on an incline upwardly from the upper, laterally inboard margin of inboard side sheet members 66, to meet at an apex above center sill 42 along the centerline of the car. In the illustrated embodiments, the closure assemblies include transverse doors. As suggested by the name, a transverse door extends cross-wise relative to the car body underframe, and the door motion is in a fore-and-aft swinging direction parallel to the center sill.

Door assembly 90 may include motion accommodating, or motion permitting, fittings, such as hinge 78. Hinge 78 may be received in a pivoting arm member, 94. Arm member 94 as may run along the back of the door pan sheet, or wing, defined by extension 64. Arm member 94 may extend generally radially away from hinge 78 toward the distal margin of extension 64, and may be a substantially planar member lying in a plane perpendicular to the axis of hinge 78. Given that hopper doors seem to be prone to abuse in service, extension sheet 64 may have a laterally extending reinforcement 96 that may run across the back of extension 64. Reinforcement 96 may have the general form of a flange or lateral reinforcement 98 running across the front lip of door assembly 90, bent to lie across the back of the webs defined by arm members 94, and inside edge reinforcement webs 92, thus forming an open box section, which, in effect, is a cross-wise extending beam. Once again, member 98 may provide a certain robustness of structure, such as may tend to discourage distortion of the distal margin of sheet 64 when the car moves with the door acting as something of a plow while the discharge section is still obstructed by the lading being discharged. Reinforcement member 98 may extend not only across the back of door assembly 90, but also across the back of the adjacent opposite handed door assembly 90 mounted on the opposite side of the car such that the two door assemblies may be yoked together, as shown in FIG. 2*b*. Door assembly 90 may also include end webs or end gussets, namely stiffeners 96, such as may tend to run predominantly radially along the back of extension 64, and being angled axially to match the profile of outside edge of opening 80 when in the closed position.

The front or forward facing surface 108, or face of the panel, or pan defined by extension 64, may, in one context, be defined in terms of facing toward the interior of the hopper, or in a direction facing toward the lading, or toward the opposed members of the hopper discharge assembly in either the closed or the open position. The front, or upward, or inward facing surface 108, however, will tend, in general, to face inwardly toward the lading. Door assembly 90 may include upstanding lips, or cheeks, or legs, such as side wall members that stand proud of the inwardly facing surface of the door. The roots may lie directly over the mating webs of the gussets. When the mating moving and stationary portions of the discharge assembly come together, the edge members may tend to seat against the opposed lateral cheek, rim or lip, such as may be defined by a backing plate, or bar welded to one or the other of items 66, 68. The door assembly 90 is driveable between open and closed positions or conditions by an operating mechanism, indicated generally as 120. Operating mechanism 120 may include an actuator 122 and a mechanical transmission 124 linking the output of actuator 122 to door assembly 90. In one context, the actuator is a drive that operates the mechanical transmission. In another context the actuator can be considered part of the mechanical transmission as being an element of operating mechanism 120, more generally.

Figure 2A:
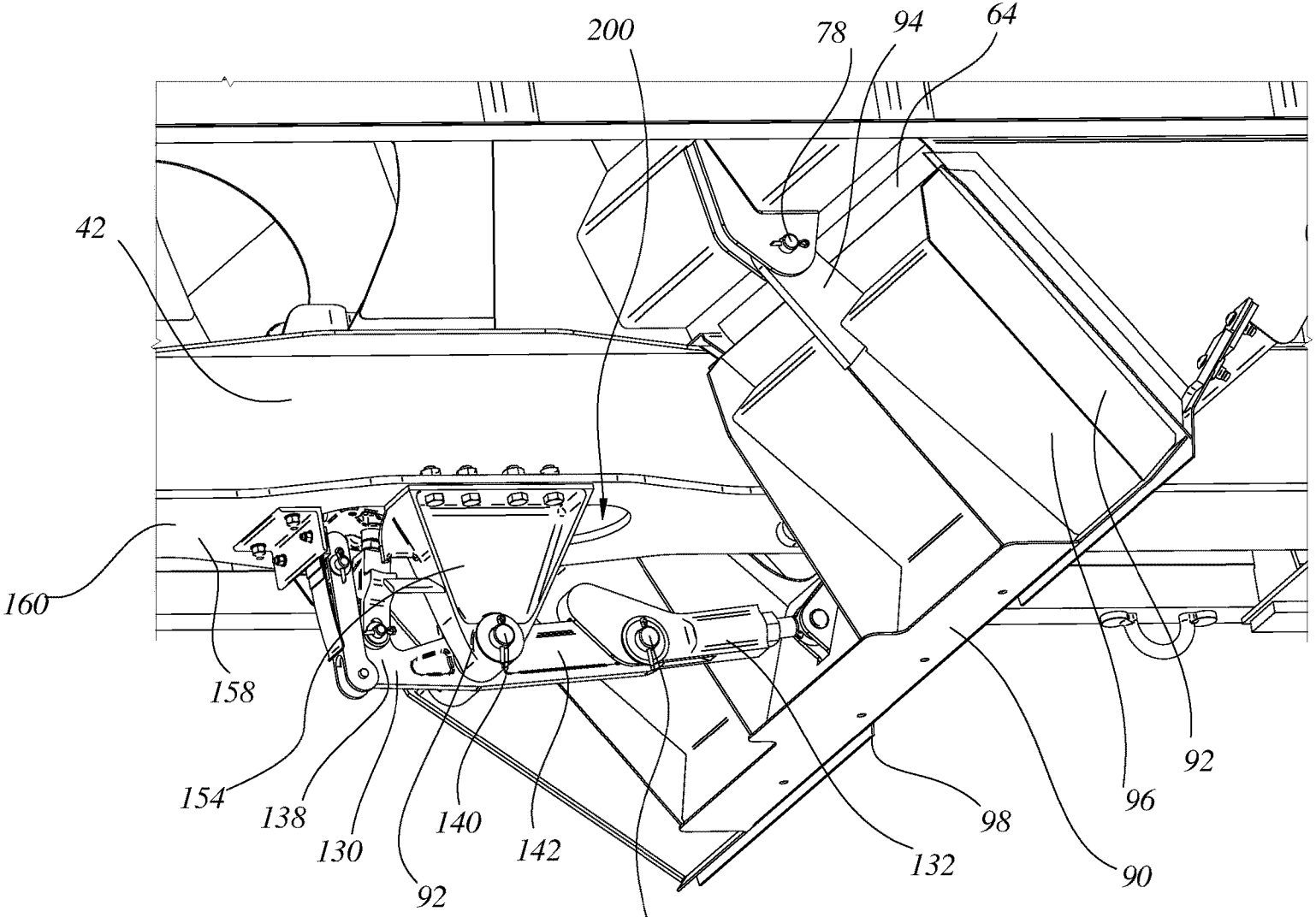
FIG. 2*a* is an isometric general arrangement view of a discharge door and actuator assembly of the freight car of FIG. 1*a;*
Figure 2B:
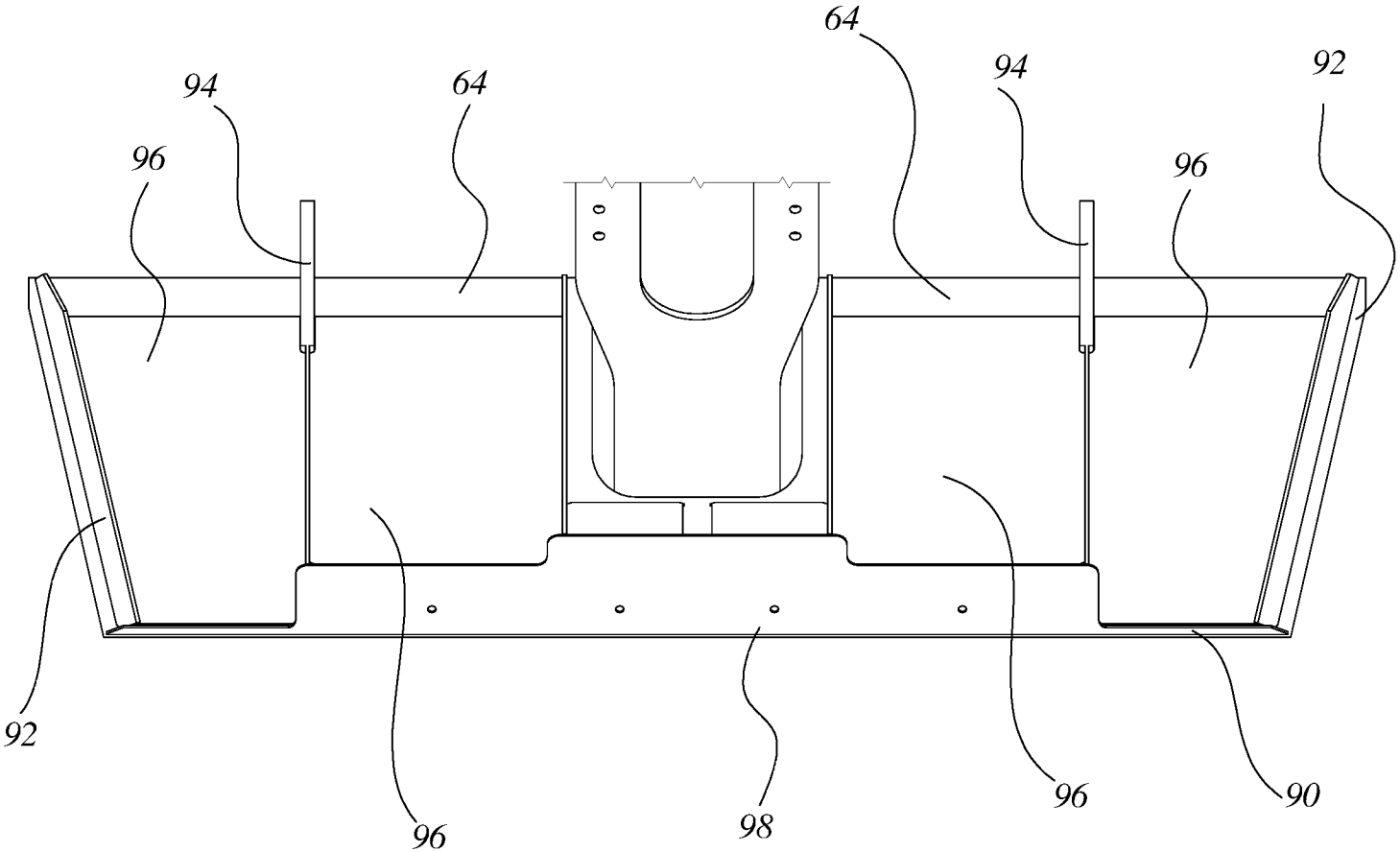
FIG. 2*b* is a projected bottom view of the door of FIG. 2*a;*

Considering FIGS. 2*a*-2*c* and 3*a*-3*c*, in the embodiment shown, actuator 122 is a pneumatic actuator having a generally cylindrical body 126 and an axially reciprocating output shaft 128. Actuator 122 is mounted in the lee of either an end slope sheet 44 or an internal slope sheet, or sheets 46, and so may tend to be somewhat protected from precipitation and damage. As discussed below, actuator 122 may also be mounted to pass at least partially within center sill 42, and may have fitting accessibly from above or below center sill 42, or both. Mechanical transmission 124 includes a first member in the nature of a driven crank, or arm, or lever 130, and a second member in the nature of a slave, or connecting link, or drag link, or follower, 132. The output of actuator 122 can have an end, or tip, or indexing member or extension 134. In terms of general operation, in one context indexing member 134 and output shaft 128 combine to function as a piston rod or pushrod. The output of that pushrod is connected at a pivotal connection 136 that is the input interface of lever 130. Lever 130 is effectively a bell crank, having an input arm 138; a central axis or pivot point or fulcrum 140; and an output arm 142, the output interface of lever 130 in this embodiment being another pivot, or pin joint 144. Pin joint 144 is likewise the input interface of drag link 132. Link 132 is a strut having a first pivot at its input interface, and a second pivot at its output interface, namely a second pin connection 146, at which it is pivotally connected to door panel assembly 90 at a radial distance from hinge fitting 78. Drag link 132 can have a pair of parallel, spaced apart webs, as seen in FIG. 2*a*, such that the connection with output arm 142 at pin connection 144 is effectively a clevis in double shear. As can be seen, output lever arm 142, drag link 132, door panel assembly 90, and the stationary structure of the car body form a four bar linkage. The input of force and displacement to this four bar linkage is delivered through the media of output shaft 128, extension 134 and input arm 138. This transmission carries force; displacement; and information, i.e., it is a mechanical door-opening signal device as well as being the means by which force and displacement are imparted to the door to implement that signal.

When the transmission is fully extended, the pivot points or pin connections 140, 144 and 146 are positioned in an over-center condition. That is to say, the force of gravity against door panel assembly 90, and particularly so if augmented by the weight of lading bearing on door panel assembly 90, may tend to want to drive lever 130 in the clockwise direction—i.e., the direction of closing, not of opening. It is prevented from further angular displacement in the clockwise direction by the over-travel range of motion limiting obstruction presented by the stop, or abutment, or dog, or catch, or pawl, or over-travel prevention pin or lug 150 that projects laterally from horn 148 of drag link 132. While the weight is on the door, pin 150 will bind against the upper margin of output arm 142. Drag link 132 can have a length adjustment, or length adjustor 152, which may typically be in the nature of a threaded rod and securement nut, which may be a wired or otherwise locked nut to prevent loosening. On assembly, adjustor 152 is set to fit the door to the door opening, with the over-travel lug in contact.

Fulcrum 140 is, or has, a pin joint formed at the apex of a fulcrum mounting fitting, or fulcrum stand, or fulcrum base, or footing 154. Base 154 has a foot or anchor or main mounting identified at flanges 156 that are rigidly attached to center sill 42. Footing 154 may have a generally triangular profile when seen in side view, and may have radial webs that extend along its edges to flanges at mounting 156 at which it is bolted to the flange, or flanges 158, of bottom cover plate 160 of center sill 42. As seen in the figures, the inboard face of footing 154, i.e., facing toward the centerline of the car, has stiffening ribs. In some contexts the entire structure may be referred to collectively as the fulcum.

Transmission 124 also has a secondary lock or secondary lock assembly, indicated generally as 162. It includes a suspended arm 164 that is pivotally mounted to the stationary structure of the car body underframe by a rigidly mounted bracket 168, in this case to bottom cover plate 160 of center sill 42. Suspended arm 164 may be biased toward engagement of transmission 124. It could be biased by gravity or other means. In the embodiment shown in FIG. 3*d* it is biased by a spring 166, which is shown as a leaf spring jointly mounted with arm 164 to a mounting bracket 168 bolted to the underside of flange 158.

The distal end of arm 164 includes a pawl, abutment, catch, dog, lug, or pin 170. The back side of the elbow of input arm 138 has a corresponding seat, or catch, or notch 172 formed therein. When transmission 124 moves to the over-center position, notch 172 will be presented to pawl 170, and, under the biasing influence of spring 166 as input arm 138 rotates clockwise pawl 170 will ride along the back face of the elbow of arm 138 until notch 172 is exposed and pawl 170 springs into place, thus capturing arm 138 and preventing return rotation in the counter-clockwise direction. Thus, even if car 20 should experience a vertical bounce that might otherwise tend to cause the over-center mechanism to jump and disengage, pawl 170 may tend to prevent such an occurrence from happening.

Indexing member 134 includes an information transmitting member in the form of a cam 174, and a lost motion element, identified as slot 176. The combination of items 174 and 176 permit indexing member 134 to function as a motion sequencing member, or information transmitting member that sets the order or schedule or sequence of steps of operation. That is, when actuator 122 operates to extend output shaft 128, the first portion of that motion takes up the slack in the linkage provided by slot 176. During the time period of this motion, cam 174 is delivering the message to secondary lock assembly 162 that it is time to permit release of pawl 170. Mechanism 120 delivers this message by causing cam 174 to bear against the near side of suspended arm 164, which acts as a cam follower. As this engagement occurs, spring 166 is compressed, and pawl 170 is disengaged from notch 172. By the time slot 176 reaches its end of travel on pin joint 136, pawl 170 is fully disengaged, and transmission 124 is ready for the next step in the sequence, namely the transmission of force and displacement from output shaft 128 to move pin joint 136, and therefore lever 130, in the counter-clockwise direction in FIG. 3*d*. When this occurs, over-travel prevention pin 150 is lifted off output arm 142 and output pin connection moves out of the over-center condition, and through the aligned position or condition. Once the mechanism has reached the aligned condition, any further motion will be aided by the weight of the door and lading, tending to move lever 130 counter-clockwise and tending to open door panel assembly 90. When it is desired to close door panel assembly 90, actuator 122 is operated in the opposite direction, and the action is reversed to close the door.

Figure 2C:
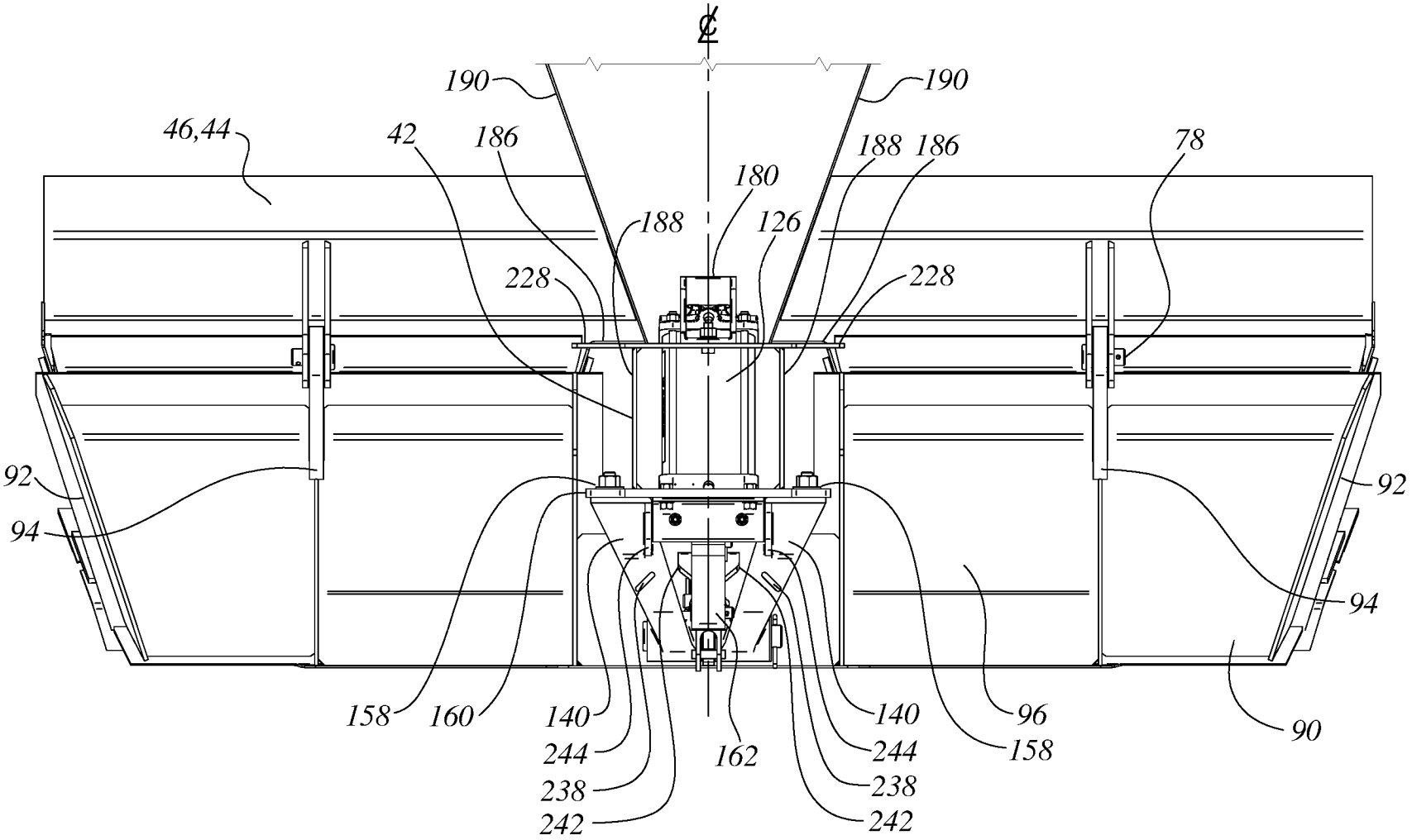
FIG. 2*c* shows a transverse cross-section of the freight car of FIG. 1*c* showing installation of an actuator within the center sill.

As best seen in the cross-sectional view of FIG. 2*c*, actuator 122 is mounted to work through center sill 42. As seen in FIG. 3*d*, the back end of cylindrical body 126 (i.e., the end facing away from output shaft 128) is pivotally mounted at pin 178 to a reaction, or reaction member, or stationary mounting, or fitting, or footing, or bracket 180, however it may be termed. It is the mounting fitting at which the reaction force provided by the structure of car 20 generally passes into, or is provided to, actuator 122. Bracket 180 has a corresponding fitting, or eye to receive pin 178, and feet 182, 184 that are rigidly secured to center sill 42, as by bolting to top cover plate 186 of center sill 42. Body 126 is suspended from pin 178 to hang predominantly vertically between webs 188 of center sill 42. It the embodiment shown, actuator 122 is located on the centerline of car 20, as is mechanical transmission 124. Body 126 swings fore-and-aft longitudinally relative to center sill 42 on pin 178 during motion, the angle varying with the moving position of pin joint 136 as it moves about fulcrum 140. Throughout this motion, actuator 122 remains predominantly upright or upstanding or vertical, (i.e., that is, a predominantly upstanding actuator is one that has a line of action of the piston being more vertical than horizontal. In the embodiments herein, the line of action is generally less than 30 degrees from vertical), with the back end being secured above the center sill top cover plate, and the output being connected below the center sill bottom cover plate. Car 20 can include "elephant ears", or shear web reinforcements 190 of slope sheets 44 and 46 that have a first, lower, edge welded to the outboard edge of the top cover plate flange of center sill 42 in line with center sill webs 188, and an upper obliquely outboard edge welded to the underside of the respective slope sheets. Actuator 122 is mounted between the roots of elephant ears 190.

Figure 3A:
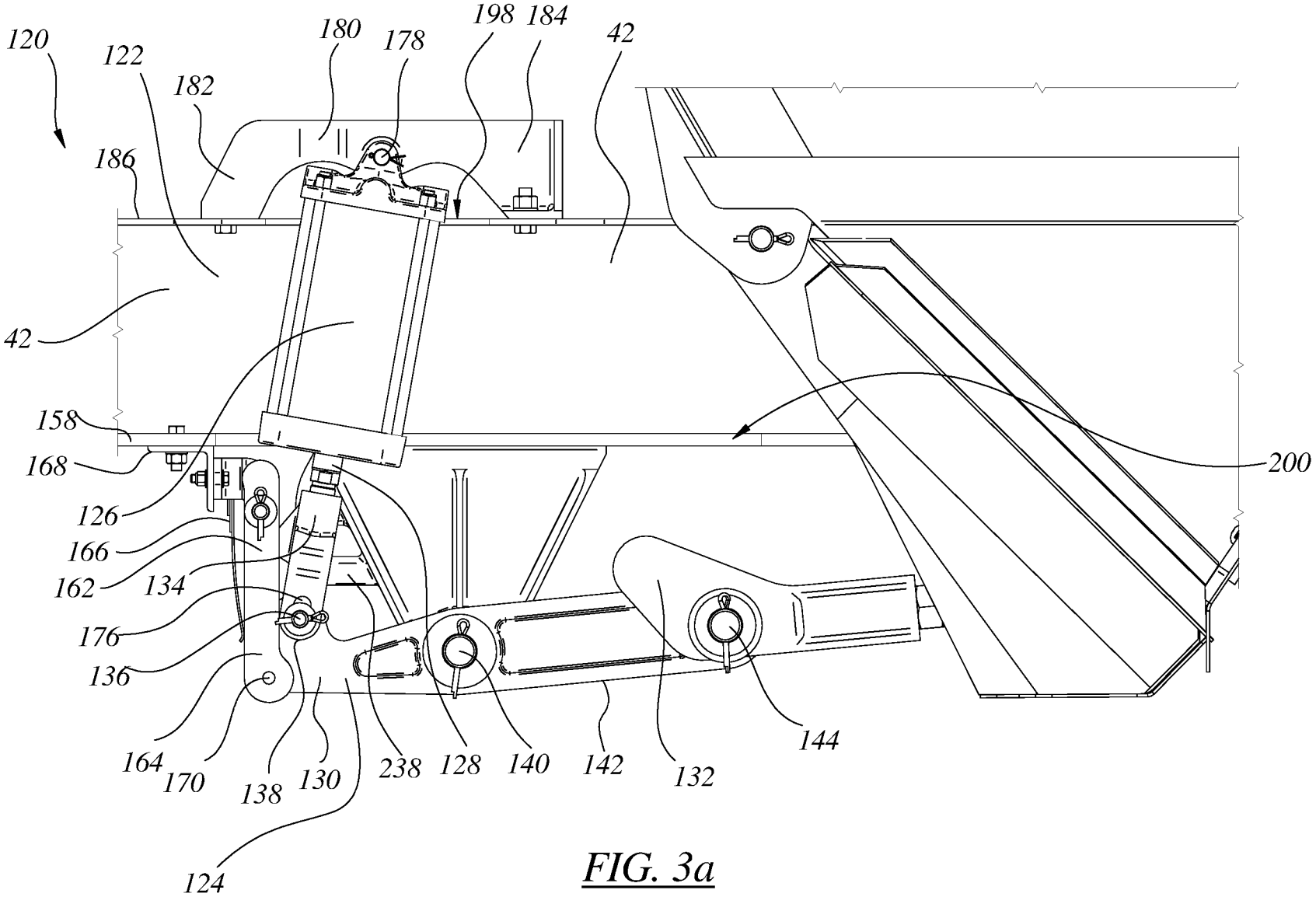
FIG. 3*a* is an enlarged side view of a door assembly and actuator of the railroad freight car of FIG. 1*e* with the near-side web of the center sill removed to reveal internal details of the actuator installation.
Figure 3B:
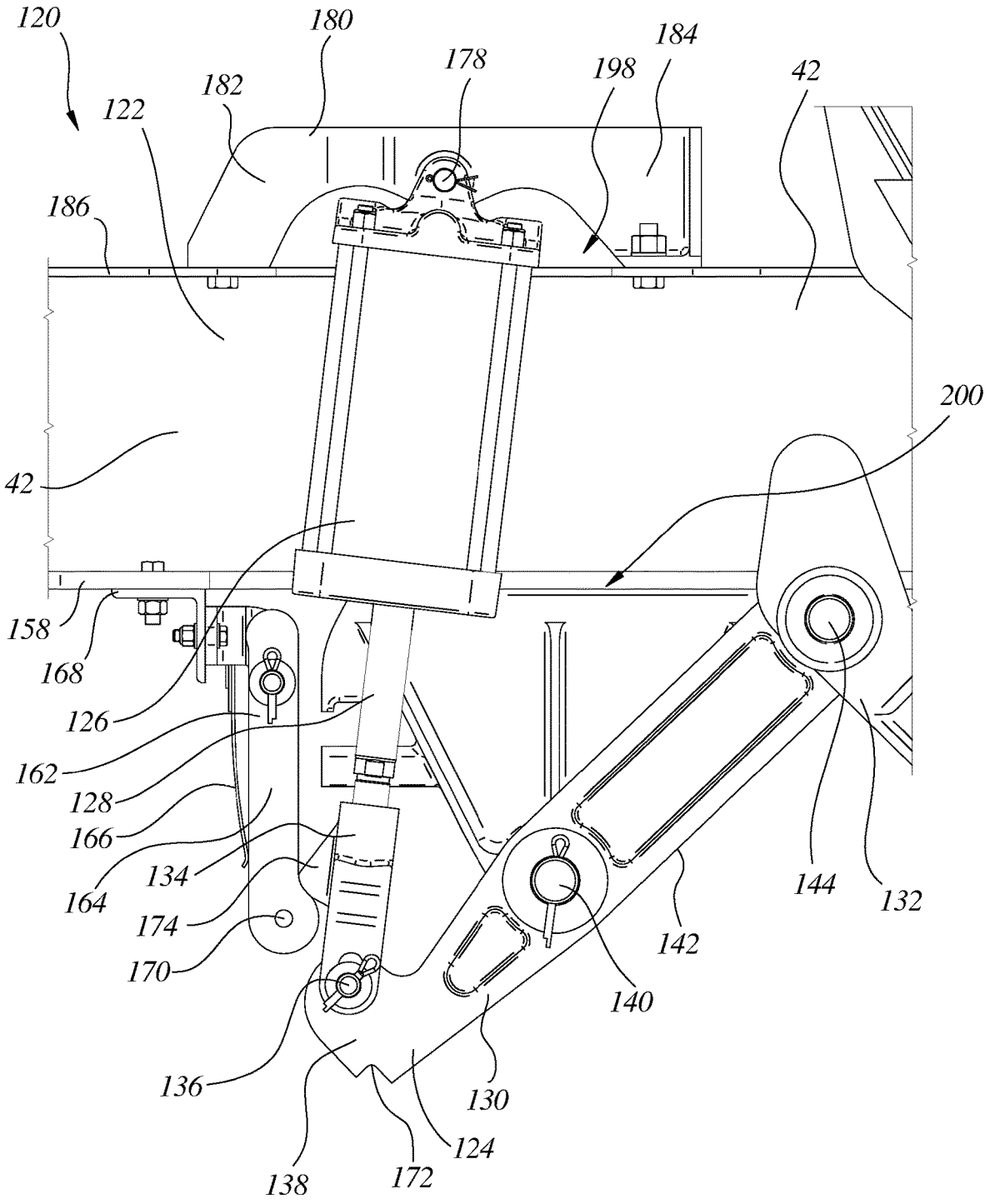
FIG. 3*b* shows the same view as FIG. 3*a*, with the door linkage partially open.
Figure 3C:
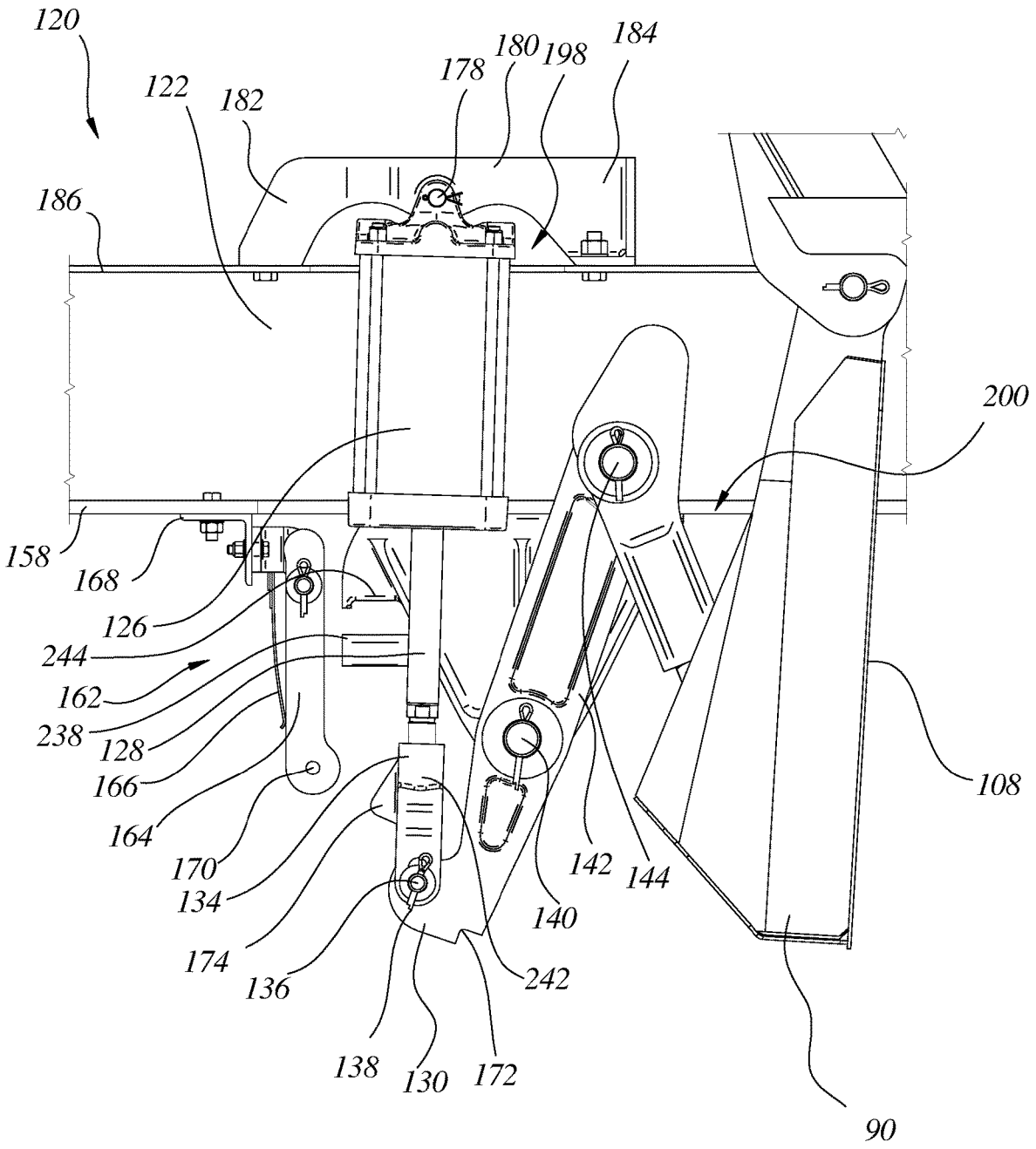
FIG. 3*c* shows the view of FIG. 3*a* with the door linkage fully open.

In the sequence of FIGS. 3*a*, 3*b* and 3*c*, during motion of mechanical transmission 124, the output arm of lever 130 and the double webs of drag link 132 fold together upwardly in a scissor, or scissor-like action. In this motion, the distal region of output arm 142, pin connection 146, and the distal portion of drag link 132 including horn 148 protrude upwardly beyond the height of bottom cover plate 160 of center sill 42. To accommodate actuator 122, bottom cover plate 160 of center sill 42 splits and deviates around actuator, such that an opening 200 is formed in bottom cover plate 160. A corresponding opening 198 is formed in top cover plate 186. Similarly, an opening is formed in bottom cover plate 160 to accommodate the motion of mechanical transmission 124. In this case, it is convenient for opening 200 to extend sufficiently far along center sill 42 to serve both functions. However, there could be two separate apertures defining the accommodation for actuator 122 and the accommodation for actuator 124.

Placing actuator 122 in a substantially vertical orientation tends to permit the actuator installation to have a relatively short extent in the x-direction along the center sill. This, in turn, may permit two such actuators 122 to be mounted more closely together, and may permit transmission 124 to fold upward and to be generally more compact than might otherwise be the case. Where the installation is more compact, it tends to be possible for the space between adjacent hoppers to be smaller, such that the hopper discharge slope sheets can be closer together. "Closer together" can imply that the longitudinal size of the hopper discharge can be larger than before. If the discharge opening is larger, discharge may tend to be more rapid.

Vertical installation, or predominantly vertical installation, rather than horizontal installation along the inside of the center sill, may also tend to encourage use of shorter-stroke cylinders, such as may be smaller. While a single cylinder may be used to drive two longitudinally adjacent door sets at one time, the squat vertical installation may also tend to encourage the use of one actuator per door set, such that individual door pairs can be opened one-at-a-time. That is, each of hoppers 50, 52 and 54 can have its left and right hand doors controlled separately from the doors of the adjacent hopper, allowing partial discharge, separate discharge, or sequenced discharge.

The doors tend to require a high volume of air due to the cylinder size used. Using a squat, vertical cylinder in the center sill may tend to permit a reduction in the length of cylinder stroke required to open and close the doors. For cars with on-board reservoirs, in particular, using less air for each operation may tend to decrease the required frequency of refilling the reservoirs, and the time required to refill the reservoirs.

Figure 1F:
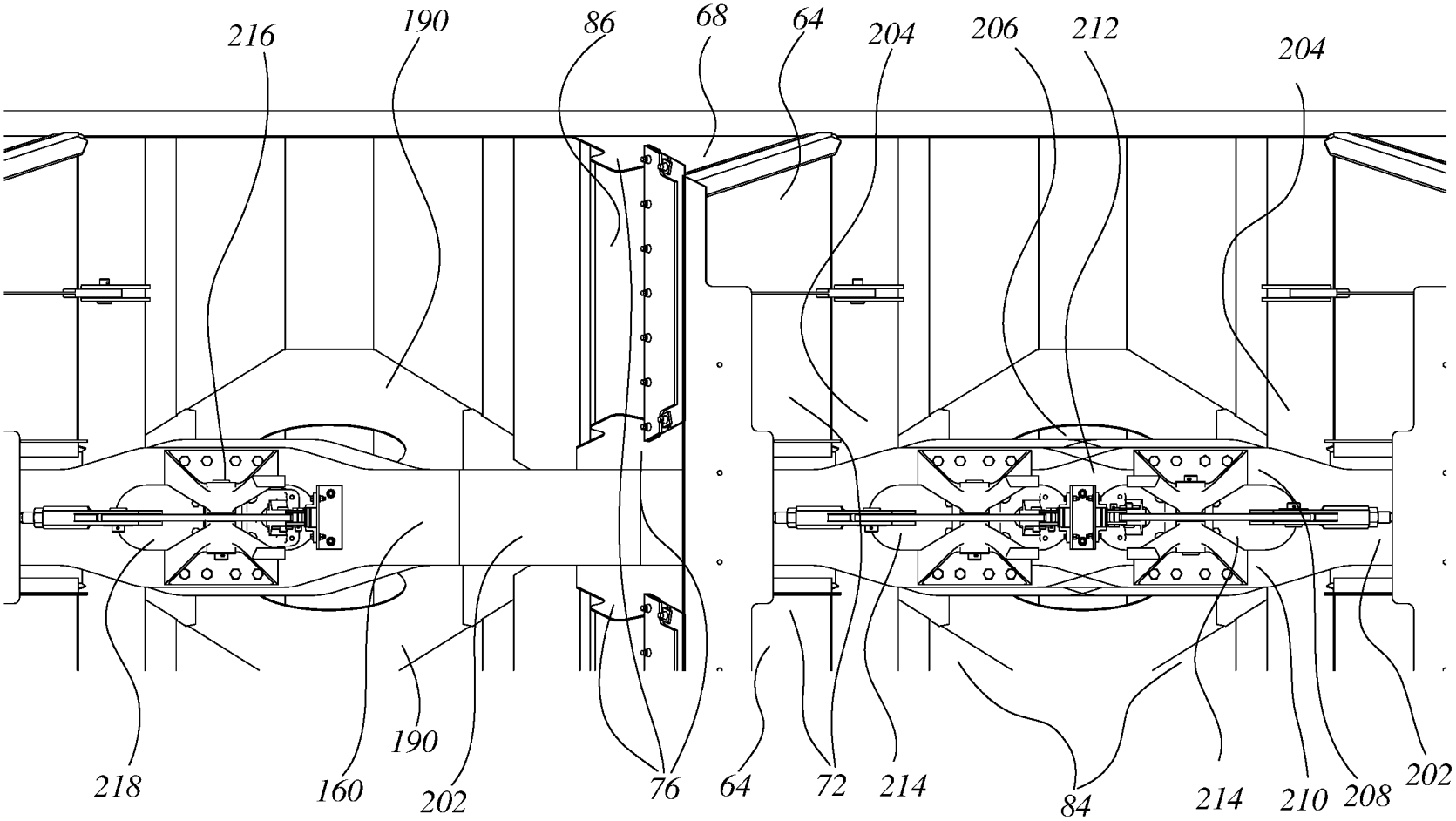
FIG. 1*f* is an enlarged detail of FIG. 1*c;*
Figure 6A:
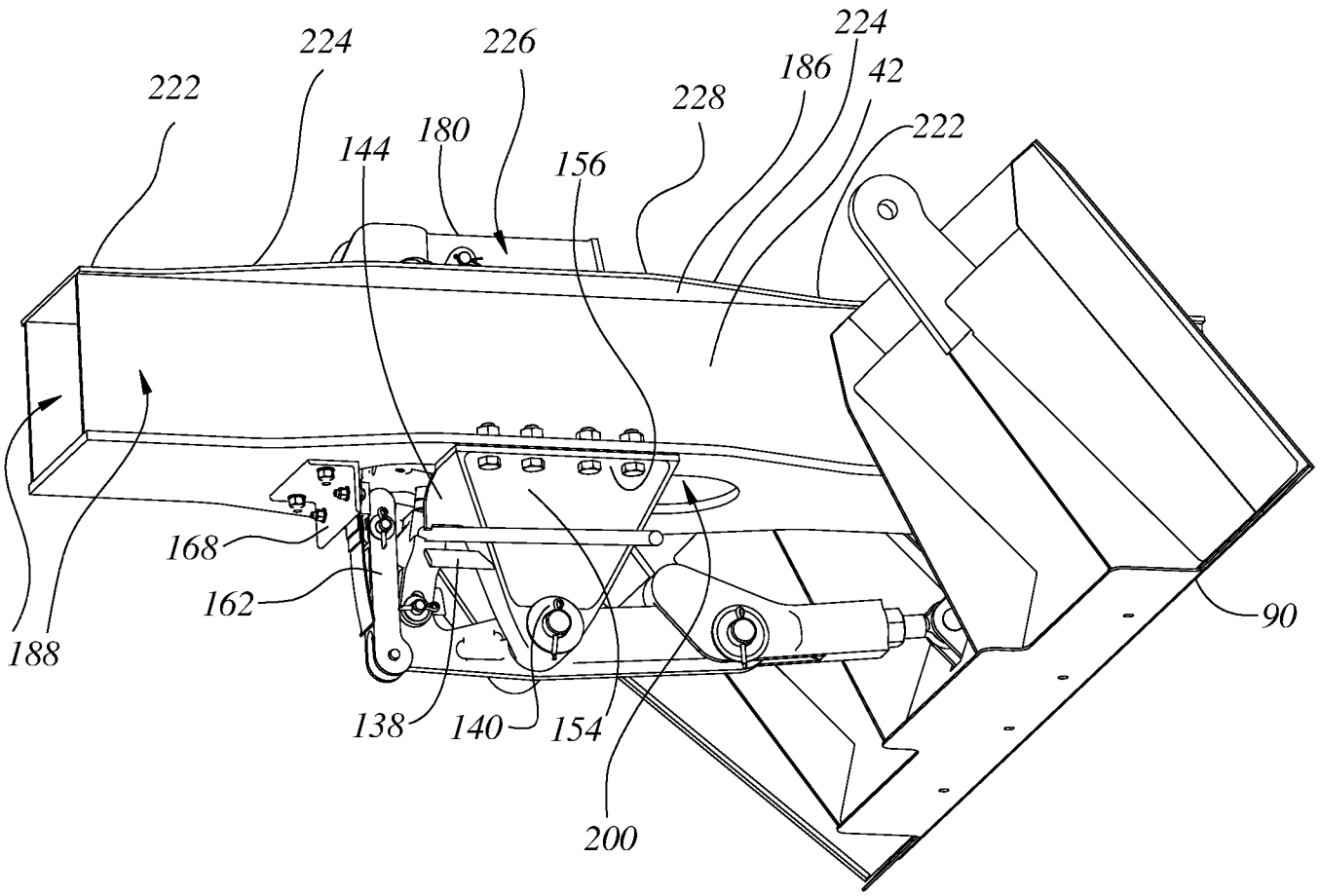
FIG. 6*a* shows a general arrangement perspective view of an alternate layout of actuator assembly to that of FIG. 3*a;*

The shortening of the length of the center sill bottom cover plate flange deviations may tend also to permit the cover plate to return to its normal width abreast of each of the discharge doors. Effectively, this permits the inboard edge of each of the left-hand and right-hand doors to be located a few inches closer to the centerline of the car, thus increasing the effective door opening width. This is shown in FIG. 1*f*. Bottom cover plate 160 has a normal, narrow width as indicated at 202, that width prevailing abreast of the region of swing of the doors in the neighborhood of inboard side sheet extension 66, almost to the hinge point. It then widens on a smooth angled, tapered transition at 204 to its broader width at 206. That broader width prevails until past the end of opening 200, where there is again another transition 204 to return to the normal width 202. Over the widened portion the bottom cover plate flange is split into left hand and right hand flange portions 208, 210 running along either side of the opening. Where there are two hopper actuators located back-to-back, as at 212, opening 200 is longer, as at 214. Where there is only a single actuator, as at 216, opening 200 is shorter, as at 218. As shown in FIG. 6*a*, the upper flange, or upper cover plate, 186 of center sill 42 also has narrow, or normal width portion 222, transition 224, and wide portion 226 with split flange halves 228.

Figure 4:
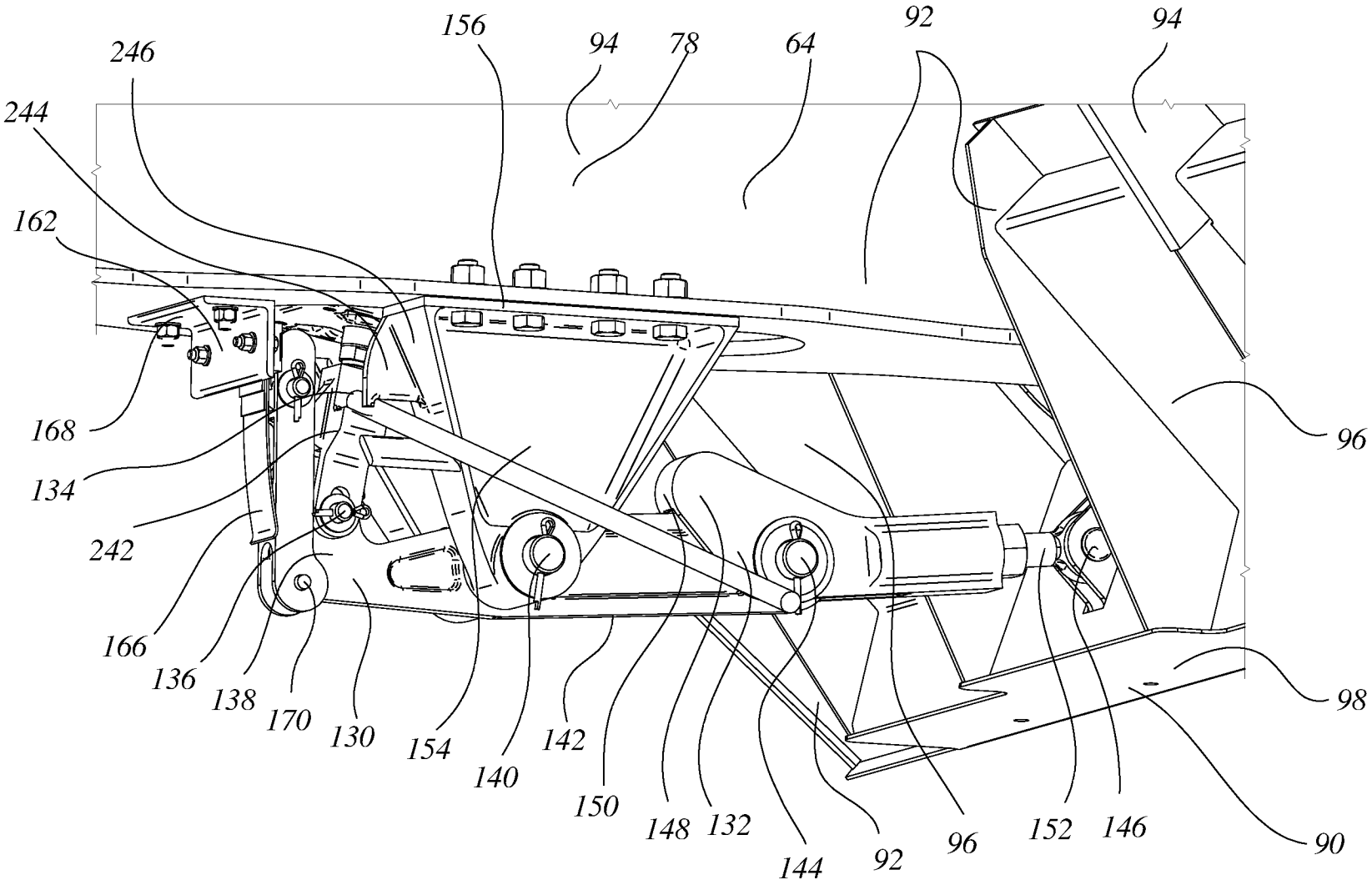
FIG. 4 is a perspective view of the actuator assembly of FIG. 3*a;*
Figure 5A:
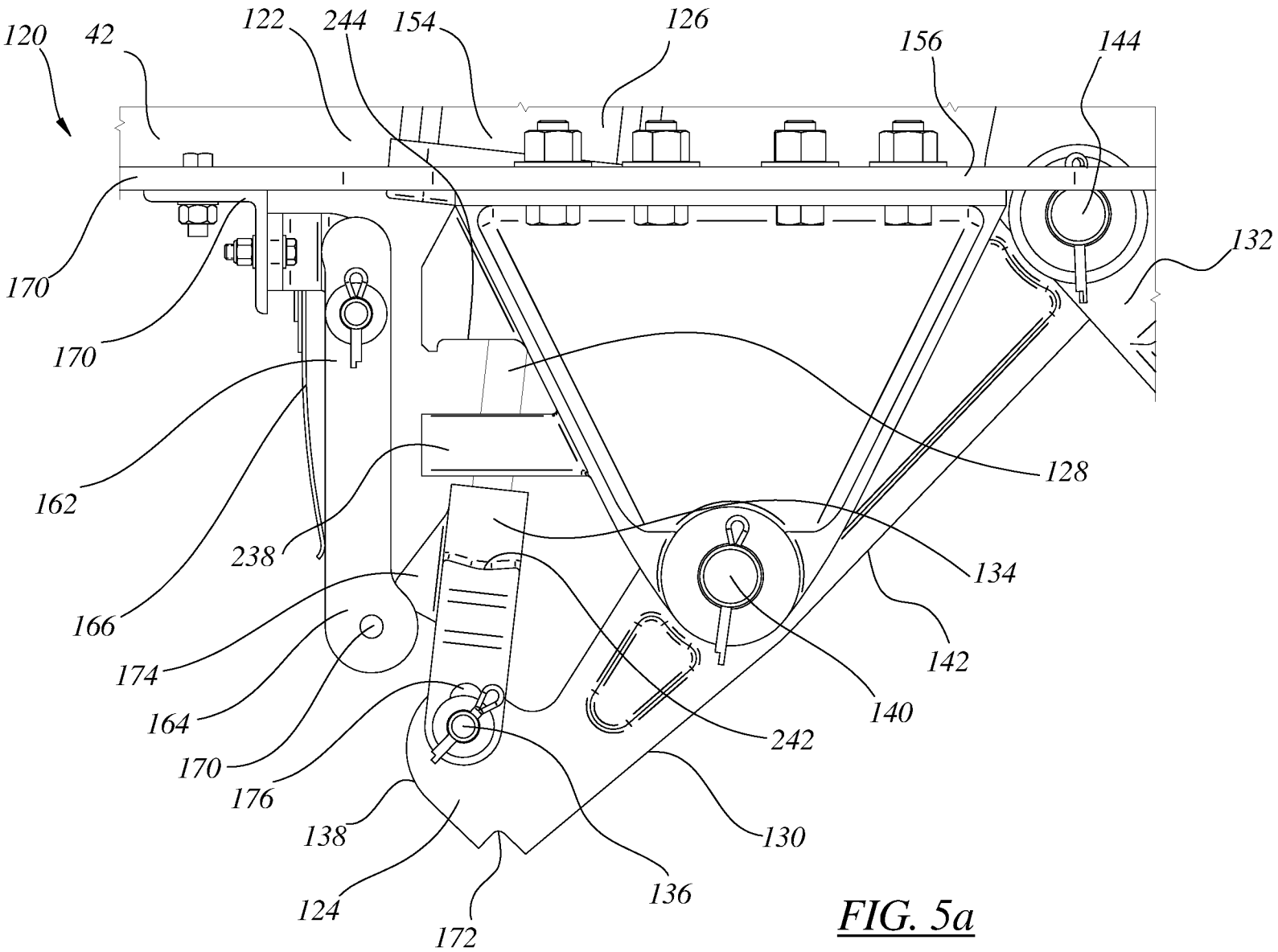
FIG. 5*a* shows an enlarged side view of detail of a secondary lock mechanism of the door linkage of FIGS. 3*a* to 3*c* in a disengaged position or condition.
Figure 5B:
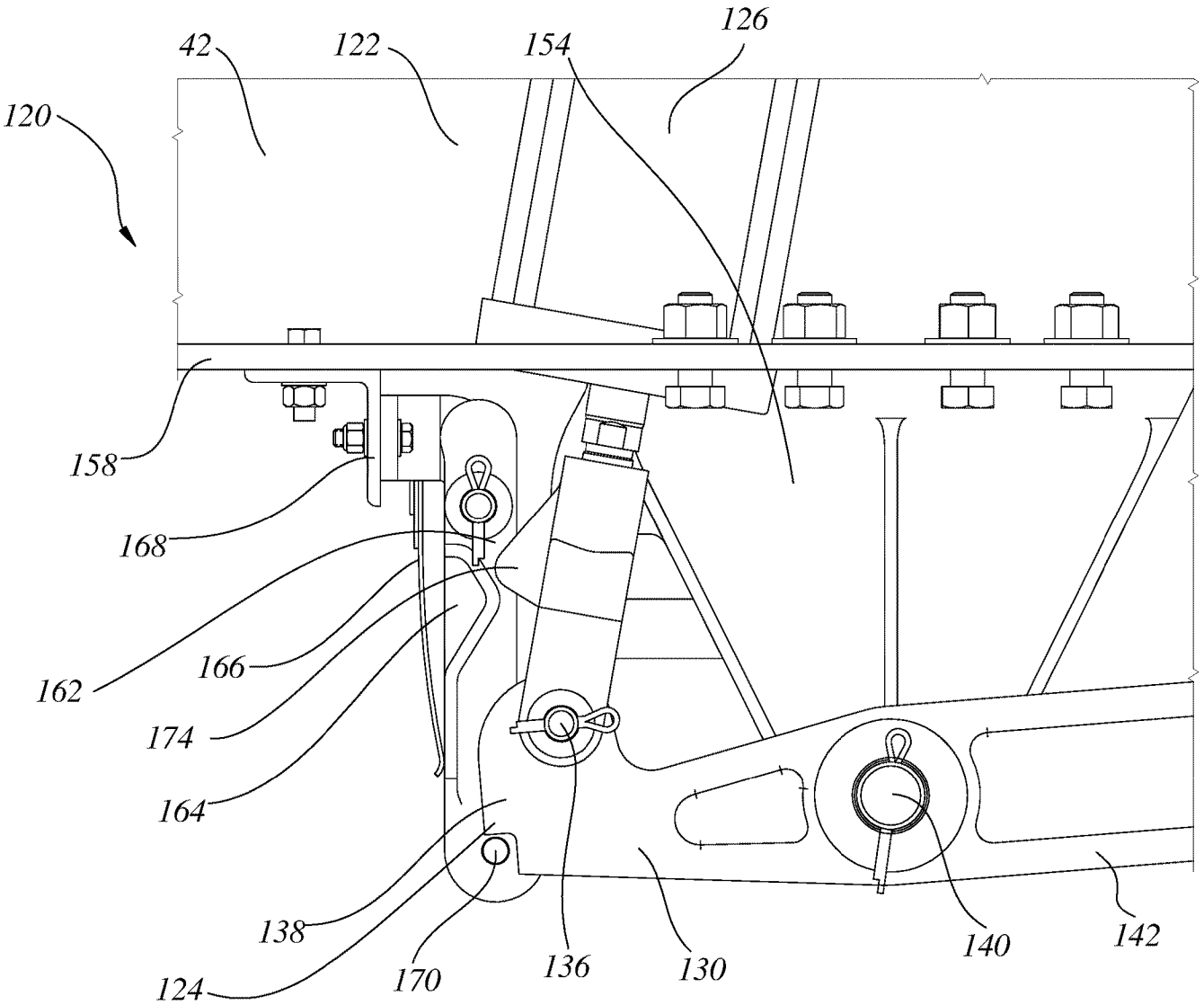
FIG. 5*b* shows the secondary lock of FIG. 5*a* in an engaged position or condition.
Figure 8:
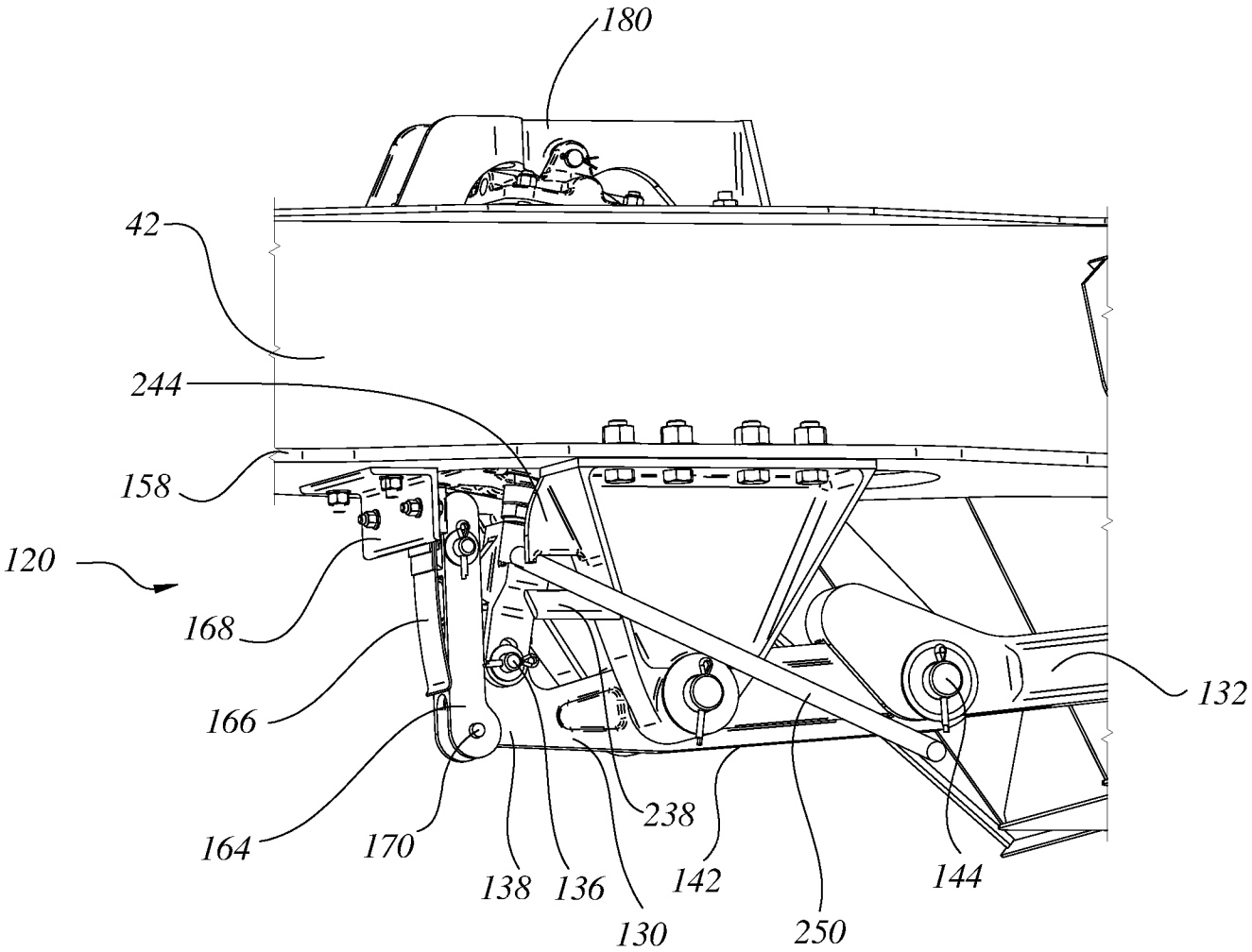
FIG. 8 shows an isometric view of a manual release for the assembly of FIG. 6*a*.

In FIG. 4 fulcrum base 154 has a shallower sloped side facing the door, and a more steeply sloped side facing the actuator. Also visible in FIG. 4, FIGS. 5*b* and 5*c*, and in FIG. 8 is an auxiliary manual release arrangement. In the manual release arrangement, extension 134 has a socket, or seat, or prying lug 242. A prying wing, or abutment, or fulcrum 244 is formed as an extension or lug on the adjacent steeper flange 246 of fulcrum base 154. A guide, or shield or vane 238 extends from flange 246 lower down the side thereof, there being an open space, effectively a notch, between vane 238 and wing 244 of a size to admit entry of a lever or pry rod 250. The slope on vane 238 may aid in placement of rod 250. In operation, the insertion of a lever, such as manual pry rod 250 by an operator standing well clear of the car at trackside permits lug 242 to be pried downward, using wing 244 as a fulcrum. When this happens, cam 174 releases secondary lock assembly 162, and then sequentially permits transmission 124 to be forced out of the over-center condition. A person standing at track side can see whether mechanical transmission 124 is in the over-center condition by virtue of an annunciator in the form of a painted arrow or an indicator arrow 248 that is fastened to output arm 142 and that points toward a corresponding marking on the back of drag link 132. In this embodiment, the operator is able to release the secondary lock and the over-center condition of the transmission with a single tool, in a single motion.

As described above there is a secondary lock assembly 162 mounted to body structure of hopper car 20. The movable member, arm 164, has a first position in which it intercepts the door transmission, and a second position in which it is disengaged from the door transmission. Pawl 170 is operable to interact with a catch, notch 172. In a further feature, the secondary lock includes a follower, the face of arm 164, that is biased to engage the cam defined by follower 174, and is operable to release secondary lock 162. The door transmission includes a sequencing member, namely extension 134, which is mounted between actuator 122 and the mechanical linkage of transmission 124. When extension 134 is moved, secondary lock 162 is released during a first portion of motion, as the lost motion of slot 176 is taken up. In this first portion of motion, neither force nor displacement is imparted to the over-center linkage. The transmission is released from a primary lock configuration, i.e., from the over-center condition, during a second portion of motion of the sequencing member after the lost motion has been exhausted. Actuator 122 then operates to drive the linkage through the sequencing member.

As described, secondary lock 162 stops the main lever from rotating without the cylinder being pressurized or activated. The "lost motion" (the amount of travel of shaft 128 before force is applied to the actuating lever) is provided in the clevis, i.e., extension 134, that attaches the cylinder rod, output shaft 128 to main lever 130. The clevis moves the secondary lock lever arm 164 clear of main lever 130 before applying force to the actuating lever when the cylinder is pressurized. The secondary lock lever is anchored to the car body. Alternatively, in other embodiments the secondary lock lever arm may be anchored to the cylinder body.

Mechanical transmission 124 has an actuator 122, a primary lock, a secondary lock, and a sequencing member, namely extension 134; and a manual release operable when actuator 122 is inactive, to release the secondary lock and the primary lock. The manual release is operable to disengage the secondary lock prior to disengagement of the primary lock. The manual release, namely prying lug 242, is mounted to extension 134. Being part of mechanical transmission 124, the manual release member is movable, while fulcrum 244 is mounted to the stationary, or datum, structure of the underframe of hopper car 20. This permits a person standing at trackside to engage the release member with a lever using the stationary member as a fulcrum. A second stationary member, namely wing 238 is mounted to car 20, thereby defining a lever guide by which to feed a first end of a lever or pry rod to engage the manual release. The mechanism is designed such that the door may be opened manually if a source of pressurized air is not available. In other mechanisms, a first action must be taken to release the secondary locking prior to a second action of rotating the main lever. The new design has both actions performed by a single operator input. A pry bar moves the cylinder clevis such that the secondary lock is disengaged and the main lever is rotated with a single motion. This provides a means of opening the door in the event that no pneumatic supply is available.

Figure 7:
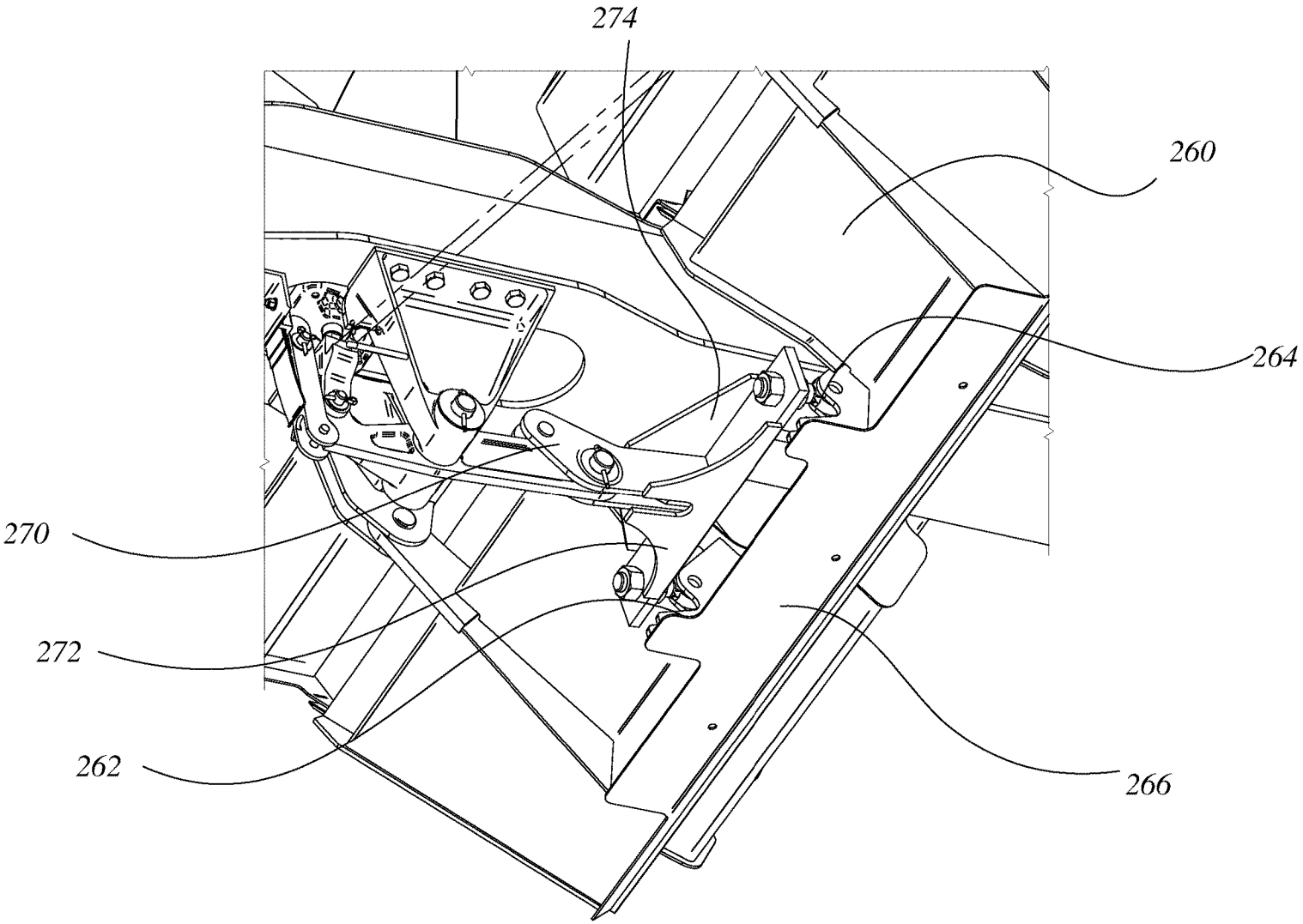
FIG. 7 shows an isometric view of an alternate door installation having a bifurcated transmission.

The assembly described above may also be used, whether by retrofit or otherwise, with cars having left and right hand doors with split force inputs, as shown in FIG. 7. Here, a door assembly 260 has left hand and right hand halves, each of which has a force input fitting 262, 264 mounted to the back of a cross-beam or yoke 266 that ties the two door halve portions together. In this case, drag link 270 is substantially the same as drag link 132 on the input end, but the output is split into first and second arms 272, 274 that are connected to the door assembly at fittings 262, 264 respectively. This fittings may be all-welded assemblies having parallel doubled webs and a pin connection in double shear.

Figure 6B:
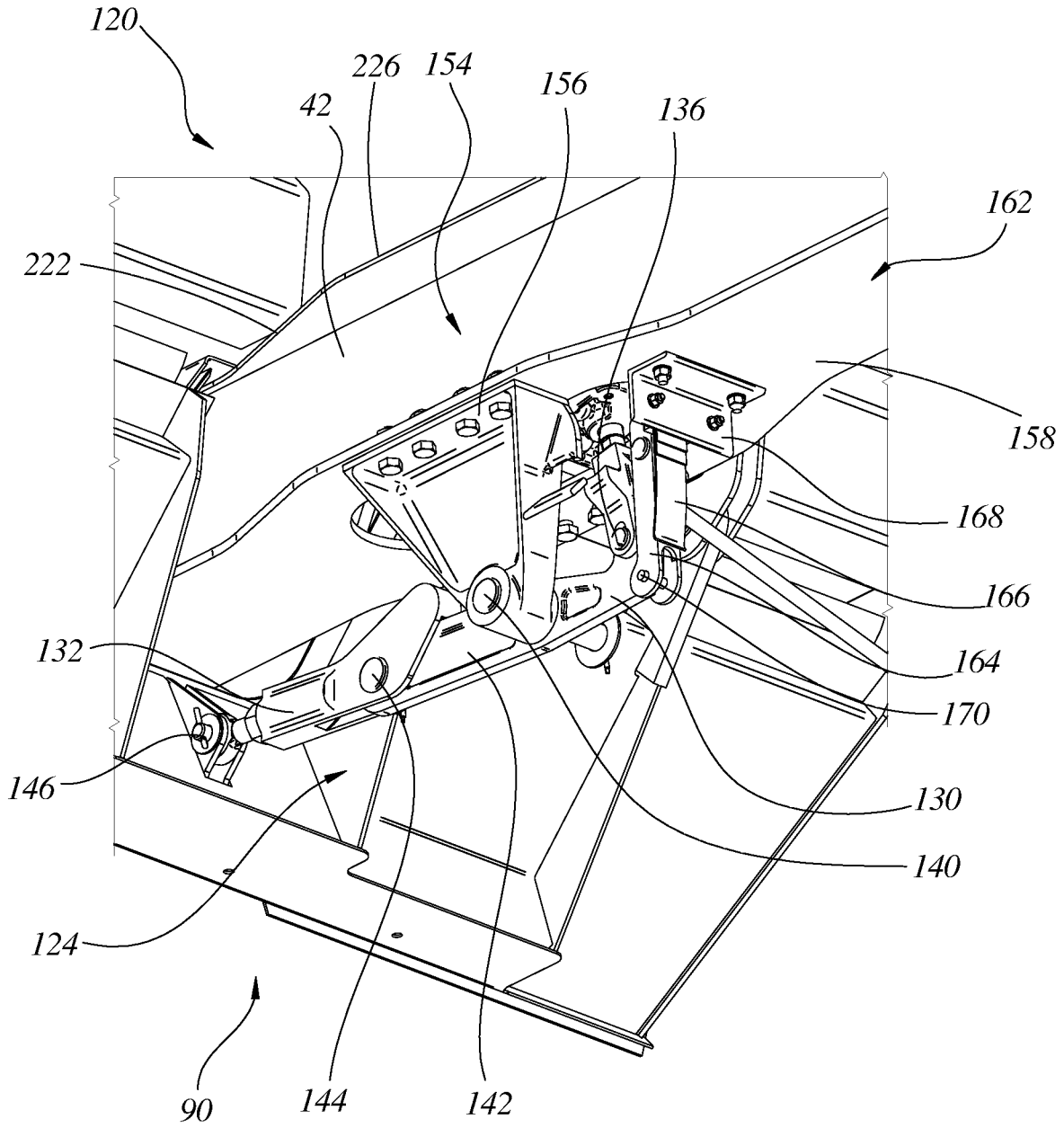
FIG. 6*b* shows a detail of the assembly of FIG. 6*a* from the opposite side and below.

The mechanisms described above are for the operation of bottom discharge doors on railroad hopper cars, whether covered or open top. Each mechanism uses a single cylinder for each pair of doors (i.e., a left-hand door, and a right hand door, yoked together). Each cylindrical actuator is oriented in a near vertical position or a position such that it does not extend between the doors, causing the area of the doors to be reduced, i.e., because the center sill flanges would otherwise have to extend to a greater width). The cylinder orientation is such that it protrudes up through the center sill. The cylinder 126 is connected to one end of a lever 130 that is located at the center line of the car. The lever fulcrum 140 is at a location below center sill 42 and is connected to support-brackets, namely of mounting base 154, that are suspended from center sill 42. The end of the lever opposite the cylinder, i.e., output arm 142, is connected to a linkage member 132. Linkage member 132 is connected to door assembly 90. Door assembly 90 has a pair of transverse doors 112, 114 on opposite sides of center sill 42. The doors are connected by a rigid beam such that the doors operate in unison. The linkage member connects at the center point of the rigid beam, as seen in FIG. 4 or FIG. 6.

In another iteration of the new design, a different method was used to connect the lever to the door. The linkage that connects to the door was generally triangular, which provided two locations for two eye bolts to connect to the door assembly. While this design was found to be heavier than the single connection, it may be used on cars already built with doors that accommodate two points of connection to the mechanism. The mechanism operates in a manner such that when in the closed position, the lever and linkage members lock the door by resting in an over-toggle position. This over-toggle position (shown in FIG. 4) causes any force on the door to rotate the lever against a rigid stop on the linkage member that prevents further rotation of either member. When the cylinder is pressurized, it causes rotation of the lever that breaks this over-toggle and causes the door to open.

The cylinder is locked by way of a secondary locking mechanism in addition to the main lever locking in over-toggle position. This mechanism uses a small locking lever that holds the main lever in the closed position until the cylinder is actuated. Lost motion in the cylinder moves the locking lever such that it disengages from the main lever prior to applying any force to the main lever. Once the locking lever is clear of the main lever, it is free to rotate in response to the cylinder applying force.

As described above, the apparatus has a substantially linear single actuating lever 130 that connects to the cylinder, i.e., actuator 122, at one end, a door linkage 132 at the other end and pivots about a central fulcrum 140. Lever 130 is approximately horizontal when reacting the forces on the door. In other embodiments, lever 130 may be at some angle other than horizontal. Lever 130 may itself form an angle, or dog leg, or curve, such that the cylinder and door linkage connection points are at less than 180 degrees from one another (could be at 90 degrees, or L shaped for example).

The apparatus described above has a cylinder (i.e., actuator 122) that extends predominantly upward from the mechanism of mechanical transmission 124 such that it is substantially out of the plane of bottom cover 160 of center sill 42. This allows the profile of the center sill to be narrower at the location of the doors, and allows the door openings to be larger. The cylinder extends up through the top cover plate 186 of center sill 42. In an alternate embodiment, the angle of the cylinder may be slightly less vertical in order to decrease the height of the top cylinder hinge point at pin 178, removing the need for an opening in the center sill top cover. That is, the mounting for pin 178 can be on the underside of cover plate 186, rather than above it. In another alternative embodiment, in the case of a car with no center sill (a stub sill design), the cylinder is oriented in a way that it does not interfere with the motion of the door or required a reduction in the door size. In this case, rather than two side-by-side door openings, there may be one continuous door that extends laterally across the car.

In each of the embodiments described the transmission includes a linkage, or assembly of linkages that connect to the door assembly at a center location, i.e., along the centerline of car 20. The connection to the door is near the bottom, or distal, edge of the door. The door connections may also be a plurality of connections that may be laterally away from the center of the door assembly. In some embodiments the linkage may connect to the door at some different location with respect to the distance from the bottom edge of the door, i.e., not quite as close to the distal margin.

Various embodiments have been described in detail. Since changes in and or additions to the above-described examples may be made without departing from the nature, spirit or scope of the invention, the invention is not to be limited to those details.

We claim:

1. A railroad hopper car having a hopper car body carried on railroad car trucks for rolling motion in a longitudinal direction, said railroad hopper car having a center sill, said railroad hopper car comprising:

a first hopper;

said first hopper having a bottom discharge;

said bottom discharge having a movable door mounted to govern egress of lading from said first hopper;

said movable door being driven by a door actuator;

said door actuator being located at the center sill;

at least a portion of said actuator is mounted within said center sill; and said door actuator being predominantly upstandingly oriented.

2. The railroad hopper car of claim 1 wherein said door is a transverse door.

3. The railroad hopper car of claim 1 wherein said railroad hopper car has first and second spaced apart side walls extending therealong, and said first hopper has a first slope sheet extending obliquely upwardly away from said bottom discharge, and said actuator is mounted in the lee of said first slope sheet.

4. The railroad hopper car of claim 1 wherein said actuator acts amidst said center sill.

5. The railroad hopper car of claim 1 wherein said actuator has a line of action that acts through said center sill.

6. The railroad hopper car of claim 1 wherein said center sill extends through said first hopper.

7. The railroad hopper car of claim 6 wherein said door of said first hopper is split into first and second portions lying laterally to either side of said center sill.

8. The railroad hopper car of claim 7 wherein said actuator is connected to said door by a mechanical transmission, and said mechanical transmission is bifurcated to drive said first and second portions.

9. The railroad hopper car of claim 8 wherein said first and second portions are yoked to sweep through a common arc together.

10. A railroad hopper car having a hopper car body supported by railroad car trucks for rolling motion in a longitudinal direction, said railroad hopper car having a center sill, said railroad hopper car comprising:

a first hopper, said first hopper having a bottom discharge;

said bottom discharge having a movable door mounted to govern egress of lading from said first hopper;

an actuator connected to drive said movable door;

said door actuator being predominantly upstandingly oriented; and at least part of said door actuator being mounted within said center sill.

11. The railroad hopper car of claim 10 wherein said center sill has a pair of spaced apart webs and a bottom flange, said bottom flange having a first portion having a first width adjacent said door, and a second portion having a second width adjacent said actuator; said first width being narrower than said second width; said door being mounted to swing beside said center sill alongside said first portion; and said second portion having an aperture formed therein to permit said actuator to work therethrough.

12. The railroad hopper car of claim 11 wherein said actuator is connected to said door by a linkage that folds at least partially into said center sill.

13. The railroad hopper car of claim 11 wherein said actuator is connected to said door by mechanical linkages, and one of said linkages has a fulcrum mounted under said center sill.

14. The railroad hopper car of claim 11 wherein said actuator has a reaction mounted on top of said center sill.

15. The railroad hopper car of claim 11 wherein said door is a transverse hopper door having first and second portions to either side of said center sill.

16. The railroad hopper car of claim 15 wherein said actuator is connected by a bifurcated linkage to drive said first and second portions of said door.

17. The railroad hopper car of claim 15 wherein said first and second portions of said door are yoked to sweep together.

18. The railroad hopper car of claim 15 wherein, in a closed position of said door, said door has a free edge most distant from said actuator; said free edge has a backing beam extending thereacross, said backing beam yoking said first and second portions of said door together; and said actuator is connected to said door by a mechanical transmission that includes a linkage mounted to said backing beam.

19. The railroad hopper car of claim 15 wherein said door is movable between an open position and a closed position; said actuator is connected to said door by linkages; said linkages are movable to an over-center condition when said door is in said closed position; and said linkages have a secondary lock operable to discourage movement out of said over-center condition when said actuator is passive.

* * * * *